US009086230B2

(12) United States Patent
Okazaki et al.

(10) Patent No.: US 9,086,230 B2
(45) Date of Patent: Jul. 21, 2015

(54) REFRIGERATION CYCLE DEVICE

(75) Inventors: Takashi Okazaki, Tokyo (JP); Mihoko Shimoji, Tokyo (JP); Shin Sekiya, Tokyo (JP); Masayuki Kakuda, Tokyo (JP); Takeshi Hatomura, Tokyo (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 1564 days.

(21) Appl. No.: 12/601,605

(22) PCT Filed: May 22, 2008

(86) PCT No.: PCT/JP2008/059461

§ 371 (c)(1),
(2), (4) Date: Dec. 18, 2009

(87) PCT Pub. No.: WO2008/146709

PCT Pub. Date: Dec. 4, 2008

(65) Prior Publication Data

US 2010/0170295 A1 Jul. 8, 2010

(30) Foreign Application Priority Data

May 25, 2007 (JP) ..... 2007-139472
Mar. 28, 2008 (JP) ..... 2008-086345

(51) Int. Cl.
*F25B 13/00* (2006.01)
*F25B 39/04* (2006.01)
(Continued)

(52) U.S. Cl.
CPC ..... *F25B 1/10* (2013.01); *F04C 18/0215* (2013.01); *F04C 23/001* (2013.01); *F25B 13/00* (2013.01);
(Continued)

(58) Field of Classification Search
CPC ..... F25B 13/00; F25B 1/10; F25B 2309/061; F25B 2313/0253; F25B 2313/02742; F25B 2400/14; F25B 2600/17; F25B 2700/2106; F25B 2700/21152; F25B 9/06; F25B 29/006
USPC ..... 62/324.6, 507, 510, 513
See application file for complete search history.

(56) References Cited

U.S. PATENT DOCUMENTS 5,689,962 A * 11/1997 Rafalovich ..... 62/90
5,927,088 A * 7/1999 Shaw ..... 62/175
(Continued)

FOREIGN PATENT DOCUMENTS

CN 1708663 12/2005
JP 10-300286 A 11/1998
(Continued)

OTHER PUBLICATIONS

Machine translation of JP 2006-071162, Satoru, Air conditioner, Mar. 16, 2006, PAJ, all pages and FIG.s.*
(Continued)

*Primary Examiner* — Allen Flanigan
*Assistant Examiner* — Filip Zec
(74) *Attorney, Agent, or Firm* — Buchanan Ingersoll & Rooney PC

(57) ABSTRACT

In order to provide a refrigeration cycle device that is compact and efficiently utilizing an expansion machine and reduced in manufacturing cost through the use of a first compressor and second compressor driven by an expansion machine, a heat radiator and an on-off valve are disposed between the first and the second compressors and the second heat radiator is utilized irrespective of the operating mode such as the cooling or heating operation. Also, the heat transfer area ratio, which is a ratio of the heat transfer area of the second heat source side heat exchanger relative to the total heat transfer area of the heat transfer areas of said first and second heat source side heat exchangers, is set, according to the air speed distribution, within a range at which the COP is at its peak. Thus, the second heat source side heat exchanger can be utilized even during the heating operation, providing a high efficiency refrigeration cycle device.

20 Claims, 17 Drawing Sheets

(51) Int. Cl.

| | |
|---|---|
| ***F25B 1/10*** | (2006.01) |
| ***F25B 41/00*** | (2006.01) |
| ***F25B 49/00*** | (2006.01) |
| ***F04C 18/02*** | (2006.01) |
| ***F04C 23/00*** | (2006.01) |
| ***F25B 29/00*** | (2006.01) |
| *F25B 9/06* | (2006.01) |

(52) U.S. Cl.

CPC ..... *F25B 29/006* (2013.01); *F25B 9/06* (2013.01); *F25B 2309/061* (2013.01); *F25B 2313/0253* (2013.01); *F25B 2313/02742* (2013.01); *F25B 2400/14* (2013.01); *F25B 2600/17* (2013.01); *F25B 2700/2106* (2013.01); *F25B 2700/21152* (2013.01)

(56) References Cited

U.S. PATENT DOCUMENTS

| | | | | |
|---|---|---|---|---|
| 5,996,368 | A * | 12/1999 | Kim | 62/324.6 |
| 6,560,980 | B2 * | 5/2003 | Gustafson et al. | 62/186 |
| 6,945,066 | B2 * | 9/2005 | Hiwata et al. | 62/324.6 |
| 7,272,948 | B2 * | 9/2007 | Taras et al. | 62/324.1 |
| 7,493,775 | B2 * | 2/2009 | Shimamoto et al. | 62/199 |
| 7,650,763 | B2 * | 1/2010 | Heyl | 62/324.1 |
| 8,109,116 | B2 | 2/2012 | Sekiya et al. | |
| 2004/0003601 | A1 * | 1/2004 | Dube | 62/81 |
| 2004/0020206 | A1 * | 2/2004 | Sullivan et al. | 60/670 |
| 2004/0144111 | A1 * | 7/2004 | Matsuoka | 62/224 |

FOREIGN PATENT DOCUMENTS

| | | | |
|---|---|---|---|
| JP | 11-094379 | A | 4/1999 |
| JP | 2003-121018 | A | 4/2003 |
| JP | 2003-279179 | A | 10/2003 |
| JP | 2004-003691 | A | 1/2004 |
| JP | 2004-144399 | A | 5/2004 |
| JP | 2005-009725 | A | 1/2005 |
| JP | 2005-291622 | A | 10/2005 |
| JP | 2006-071162 | A | 3/2006 |
| JP | 2006-153332 | A | 6/2006 |
| JP | 2006-207835 | A | 8/2006 |
| JP | 2006-242491 | A | 9/2006 |
| JP | 2007-115096 | A | 5/2007 |
| JP | 2007-192508 | A | 8/2007 |
| WO | WO 2004/038307 | | 5/2004 |
| WO | 2007/023599 | A1 | 3/2007 |

OTHER PUBLICATIONS

International Search Report (PCT/ISA/210) for PCT/JP2008/059461 mailed Jul. 15, 2008.

Office Action from Japanese Patent Office issued in corresponding Japanese Patent Application No. 2009-516282 dated Mar. 1, 2011.

Office Action dated Mar. 23, 2011, issued in the corresponding Chinese Patent Application No. 200880017445.3.

Extended European Search Report issued on Oct. 7, 2013, by the European Patent Office in corresponding European Patent Application No. 08753092.9. (17 pages).

* cited by examiner

REFRIGERATION CYCLE DEVICE

TECHNICAL FIELD

This invention relates to a refrigeration cycle device utilizing a super critical fluid and, more particularly, to a refrigeration cycle device utilizing an expansion machine.

BACKGROUND ART

While a refrigeration cycle device utilizing a Freon family refrigerant has been widely used as a multiple air conditioner for office buildings, a super critical refrigeration cycle utilizing a super critical fluid such as $CO_2$ refrigerant is recently suggested to be installed in a multiple air conditioner for office buildings.

A super critical fluid is in a super critical state at the high pressure side, and the low pressure side is also at a higher pressure as compare to that of the Freon family refrigerant, so that the refrigeration system using the super critical fluid is a trans-critical cycle ranging over the critical point, providing a condition different from the conventional refrigeration cycle. Because of such the large difference between the high and low pressure, the input value of the air conditioning system needs to be large, and the super critical fluid generates a large temperature difference, different from the fluid of the vapor-liquid phase, so that, during the cooling operation when the outdoor air temperature is high, the temperature difference relative to the outdoor temperature is small, a sufficient heat exchange cannot be being performed, leading to an insufficient cooling, resulting in a COP inferior to that of the air conditioner utilizing the conventional Freon refrigerant.

Therefore, in order to suppress the high pressure at the compressor discharge portion and maintain the refrigerant ability of the super critical fluid, an expansion machine is installed and an intermediate cooler is utilized. An explanation will now be made as to a conventional example in which a second heat source side heat exchanger (second gas cooler) is used in the refrigeration cycle utilizing the second compressor driven by an expansion power recovered by an expansion machine. In the conventional example, an intermediate cooling system has been adopted, in which the second heat source side heat exchanger is disposed in a pipe between the first compressor and the second compressor, and the high pressure refrigerant compressed by the compressor is cooled by the second heat source side heat exchanger before it is compressed by the second compressor (see patent document 1, for example).

With such the construction, as compared to the compression stroke without using the intermediate cooling by the second heat source side heat exchanger, the intermediate two-stage compression needs less work for the compression, providing a higher COP for the same refrigeration capacity. Also, the COP during the heating operation is less improved than that during the cooling operation, so that the second heat source side heat exchanger is disposed in the outdoor unit and arranged to be operated only during the cooling operation in which a large improvement in efficiency can be obtained.

[Patent Document 1] Japanese Patent Laid-Open No. 2003-279179 (claim 5, FIG. 14, etc.)

DISCLOSURE OF INVENTION

In the conventional example, the construction was such that the second heat source side heat exchanger (second gas cooler) is used in a flow path between the low pressure main compressor and the high pressure sub compressor. When the second heat source side heat exchanger is disposed in a flow path between the low pressure main compressor and the high pressure sub compressor, the second heat source heat exchanger has been bypassed during the cooling operation, the heat transfer area of the evaporator is decreased, disadvantageously degrading the efficiency of the refrigerant.

Also, since the heat transfer area ratio of the first heat source side heat exchanger and the second heat source side heat exchanger has not been optimized against the volume ratio of the expansion machine volume and the second compressor volume, the expansion machine was poor in the poor recovery efficiency, disadvantageously degrading the efficiency. Also, the heat dissipation amount of the second heat source side heat exchanger has not been optimized in accordance with the environmental conditions such as the outdoor temperature, indoor temperature, air conditioner load and the like, so that the efficiency was not high.

Also, since the relationship between the heat radiator outlet temperature and the opening and closing operation of the pre-expansion valve and the bypass valve has not been clear, those valves could not properly be controlled, degrading the power recovery efficiency at the expansion machine.

Also, since the air speed distribution in the heat exchanger relative to the column direction has not been taken into consideration, the heat exchanger had a air speed profile in the direction of column of the heat exchanger in the actual use of the first and the second heat source side heat exchangers, undesirably decreasing the efficiency. Also, since the first and the second heat source side heat exchangers were independently used, the circuit structure was complex and the manufacturing cost was increased.

The present invention was made to solve the above problems of the conventional design and has as its object the provision of a refrigeration cycle device that efficiently utilizes an expansion machine, decreases the installation space for the heat exchanger and that decreases the manufacturing cost of the unit.

In order to solve the above problems, the present invention provides a refrigeration cycle device comprising a first compressor, a second compressor driven by recovered power recovered by an expansion machine, refrigerant flow path changeover means, a load side heat exchanger, a first heat source side heat exchanger and a second heat source side heat exchanger, and changeable between a cooling operation and a heating operation by said refrigerant flow path change-over means; wherein said second compressor and said first compressor are connected in series; said second heat source side heat exchanger is disposed between said first compressor and said second compressor during the cooling operation, and wherein the operation is performed by the utilization of said first heat source side heat exchanger and said second heat source side heat exchanger irrespective of operation mode.

The present invention also provides a refrigeration cycle device comprising a first compressor, a second compressor driven by recovered power recovered by an expansion machine, refrigerant flow path changeover means, a load side heat exchanger, a first heat source side heat exchanger and a second heat source side heat exchanger, and changeable between a cooling operation and a heating operation by said refrigerant flow path changeover means; wherein said second compressor and said first compressor are connected in series; said second heat source side heat exchanger is disposed between said first compressor and said second compressor during the cooling operation, and wherein heat transfer area ratio, which is a ratio of the heat transfer area of the second heat source side heat exchanger relative to the total heat transfer area of the heat transfer areas of said first and second heat source side heat exchangers provided on the high pressure side, is made 0.2-0.6.

The present invention also provides a refrigeration cycle device, wherein an indoor unit self-containing a first compressor, a second compressor driven by recovered power recovered by an expansion machine, and a plurality of indoor units self-containing a load side heat exchanger and an on-off valve are connected by a pipe, and said plurality of indoor units are independently changeable between a cooling operation and a heating operation; wherein said second compressor and said first compressor are connected in series; said second heat source side heat exchanger is disposed between said first compressor and said second compressor during the cooling operation, and wherein the operation is performed by the utilization of said first heat source side heat exchanger and said second heat source side heat exchanger irrespective of the operation modes of said indoor units.

The present invention also provides a refrigeration cycle device comprising a first compressor, a second compressor driven by recovered power recovered by an expansion machine, refrigerant flow path changeover means, a load side heat exchanger, a first heat source side heat exchanger and a second heat source side heat exchanger; wherein said first compressor and said second compressor are connected in series in a refrigerant flow path; said second heat source side heat exchanger is disposed in a flow path between said first compressor and said second compressor during the cooling operation; said first heat source side heat exchanger and said second heat source side heat exchanger during the cooling operation are in an integral structure or in a divided structure so that fins are not common in the direction of column; and wherein heat transfer area ratio, which is a ratio of the heat transfer area of the second heat source side heat exchanger relative to the total heat transfer area of the heat transfer areas of said first and second heat source side heat exchangers, is set, according to the air speed distribution, with the air speed distributions of said first and second heat source side heat exchanger taken into consideration, within a range including a point at which the COP is at a maximal.

The present invention also provides a refrigeration cycle device comprising a first compressor, a second compressor driven by recovered power recovered by an expansion machine, refrigerant flow path changeover means, a load side heat exchanger, a first heat source side heat exchanger and a second heat source side heat exchanger; wherein said first compressor and said second compressor are connected in series in a refrigerant flow path; said second heat source side heat exchanger is disposed in a flow path between said first compressor and said second compressor during the cooling operation; said first heat source side heat exchanger and said second heat source side heat exchanger during the cooling operation are in an integral structure or in a divided structure so that fins are not common in the direction of column; and wherein a fan is disposed higher than or beside of the heat exchanger and said second heat source side heat exchanger is disposed down stream side of said first heat source side heat exchangers.

The present invention also provides a refrigeration cycle device comprising a first compressor, a second compressor driven by recovered power recovered by an expansion machine, refrigerant flow path changeover means, a load side heat exchanger, a first heat source side heat exchanger and a second heat source side heat exchanger; wherein said first compressor and said second compressor are connected in series in a refrigerant flow path; said second heat source side heat exchanger is disposed in a flow path between said first compressor and said second compressor during the cooling operation; said first heat source side heat exchanger and said second heat source side heat exchanger during the cooling operation are in an integral structure or in a divided structure so that fins are not common in the direction of column; and wherein a fan is disposed higher than or beside of the heat exchanger and said second heat source side heat exchanger is disposed down stream side of said first heat source side heat exchangers.

ADVANTAGEOUS RESULTS OF THE INVENTION

According to the present invention, the second heat source side heat exchanger is utilized even during the heating operation, so that the heat transfer area of the evaporator is increased as compared to the conventional design, enabling to provide a refrigeration cycle device of a high efficiency. Also, by optimizing the heat transfer area ratio between the first heat source side heat exchanger and the second heat source side heat exchanger and the volume ratio of the expanding machine volume and the second compressor volume, the efficiency of the refrigeration cycle can be improved. Further, by modifying the heat radiation amount of the first heat source side heat exchanger or the second heat source side heat exchanger according to the environmental conditions, a high efficiency of the refrigeration cycle can be always maintained.

According to the present invention, by taking into consideration the heat transfer area ratio of the first heat source side heat exchanger and the second heat source side heat exchanger and the volume ration of the expansion machine volume and the second compressor volume as well as the air speed distribution, when the actual air conditioner utilizes the first heat source side heat exchanger and the second heat source side heat exchanger, the concrete structure and the installation are determined, and a refrigeration cycle device of a high efficiency can be provided. Also, the second heat source side heat exchanger is utilized during the heating operation, the heat transfer area of the evaporator is increased as compared to the conventional example, enabling the provision of a high efficiency refrigeration cycle device.

Also, when the first heat source side heat exchanger and the second heat source side heat exchanger are actually put in use, they can be manufactured and installed similarly to the conventional heat exchanger, so that the circuit construction can be simplified and the installation space for the first heat source side heat exchanger and the second heat source side heat exchanger can be simplified, so that the manufacturing cost can be reduced.

BEST MODE FOR CARRYING OUT THE INVENTION

The description will now be made in terms of a refrigerant cycle device according to embodiment 1 of the present invention.

Embodiment 1

Figure 1:
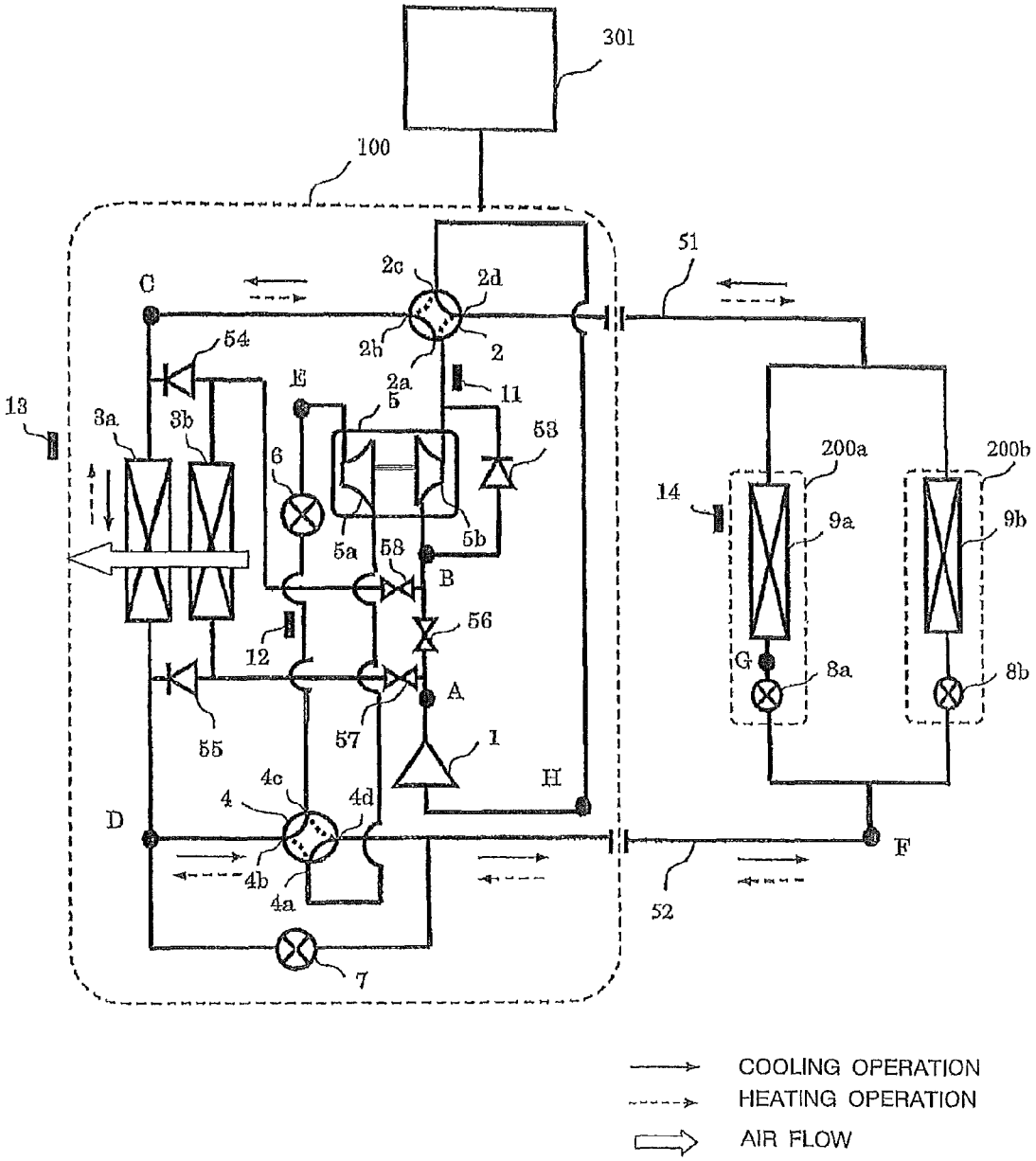
FIG. 1 is a view showing the construction of the refrigeration cycle device of the present invention (Embodiment 1).

FIG. 1 is a schematic diagram showing a refrigerant cycle device according to the embodiment 1 of the present invention. In the figure, the refrigerant cycle device of this embodiment comprises an outdoor unit 100 self-containing a first outdoor heat exchanger 3*a* which is a first heat source side heat exchanger, a second outdoor heat exchanger 3*b* which is a second heat source side heat exchanger, indoor units 200*a*, 200*b* self-containing an indoor heat exchangers 9*a*, 9*b* which are load side heat exchanger and a gas pipe 51 and a liquid pipe 52 connecting the outdoor unit 100 and the indoor units 200*a*, 200*b*. Filled within this refrigerant circuit as a refrigerant is for example carbon dioxide which becomes the critical state at a critical temperature (about 31 degree Celsius).

The indoor unit 100 comprises a first compressor 1 for compressing a refrigerant gas, a four-way valve 2 and a four-way valve 4 which are refrigerant flow path change-over means for changing the direction of flow of the refrigerant in accordance with the operation mode of the indoor units 200*a* and 200*b*, a first outdoor heat exchanger 3*a* and a second outdoor heat exchanger 3*b* which serves as a heat radiator or an evaporator in accordance with the operation mode, an expansion machine unit 5 in which an expansion machine 5*a* and the second compressor 5*b* are integrally constructed, and an unillustrated blower for supplying outdoor air to the outer surface of the first outdoor heat exchanger 3*a* and the second outdoor heat exchanger 3*b*, the entire unit being installed outdoor. Also, the first outdoor heat exchanger 3*a* is disposed between the four-way valve 2 and the four-way valve 4, and the second outdoor heat exchanger 3*b* is disposed between the first compressor 1 and the second compressor 5*b* during the cooling operation. Disposed within the expansion machine unit 5 are the expansion machine 5*a* and the second compressor 5*b*, which are connected together by a common shaft. In the expansion machine unit 5, the expansion machine 5 and the second compressor 5*a* for example are both composed of the scroll type expansion machine and the compressor, the loads in the thrust direction in the expansion machine and the compressor are cancelled out at both surfaces. The second compressor 5*b* has formed therein a bypass circuit, the bypass circuit having a bypass valve 53 therein. In order to equalize the passing refrigerant flow rate and the power at the expansion machine 5*a* and the second compressor 5*b*, the expansion machine 5*a* has, at the inlet side thereof, an on-off valve 6 (hereinafter referred to as a pre-expansion valve 6) connected in series and an on-off valve 7 (hereinafter referred to as a bypass valve 7) connected in parallel. Also, the first outdoor heat exchanger 3*a* and the second outdoor heat exchanger 3*b* are connected via check valves 54 and 55 as on-off valve, the check valves 54 and 55 are set at a minimum operation pressure difference (0.5 MPa, for example). Also, electromagnetic valves 57 and 58 which are on-off valves are disposed at the inlet portion of the outdoor heat exchanger 3*b*.

The indoor units 200*a* and 200*b* comprises indoor heat exchangers 9*a* and 9*b* which are load side heat exchangers, electronic expansion valves 8*a* and 8*b* which are depressurizing means capable of changing the opening degree for regulating the refrigerant distribution to the indoor heat exchangers 9*a* and 9*b*, and unillustrated blower and piping for supplying a forced indoor air flow onto the outer surface of the indoor heat exchangers 9*a* and 9*b*. The indoor heat exchangers 9*a* and 9*b* are connected at their one ends to the gas pipe 51 and at the other ends to the liquid pipe 52 via the electronic expansion valves 8*a* and 8*b*. It is to be noted that, while two indoor units 200*a* and 200*b* are shown in this embodiment, they may be one or more than three. Also, the electronic expansion valves 8*a* and 8*b* which are the depressurizing means having a variable degree of opening for adjusting the refrigerant distribution to the indoor heat exchangers 9*a* and 9*b* may not be used and an expansion machine may be used as the depressurizing mans instead.

Also, to obtain target values for the balance control of the passing refrigerant flow rate and the power at the expansion machine unit 5, a discharge temperature detector 11 of the second compressor 5*b*, an outlet temperature detector 12 of the first outdoor heat exchanger 3*a*, an outdoor air temperature detector 13, and an indoor temperature detector 14 are provided. The data from them are supplied to an unillustrated controller to perform the necessary operation therein and commands of the degree of opening are transmitted to the pre-expansion valve 6 and the bypass valve 7 which are actuators.

Figure 2:
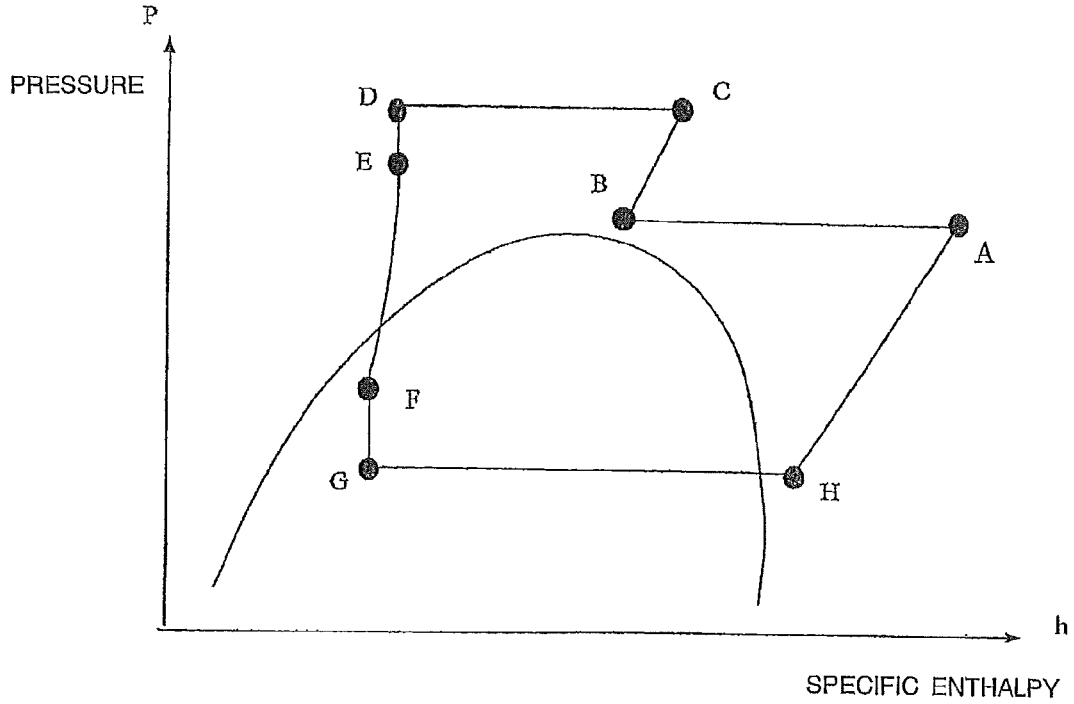
FIG. 2 is a view showing the cooling operation on the P-h diagram of the refrigeration cycle device of the present invention (Embodiment 1).

The operation of the refrigerant cycle device having the structure as described above will now be described. It is to be noted that the operation which will be explained bellow is performed by the controller 300. First, the operation for cooling will be explained on the basis of FIGS. 1 and 2. FIG. 2 is a graph showing the states of the refrigerant at points A-H in the refrigerant circuit shown in FIG. 1 are plotted on the P-h diagram. During the cooling operation, the four-way valve 2 in the outdoor unit 100 is set so that the first port 2*a* and the second port 2*b* are in communication with each other and the third port 2*c* and the fourth port 2*d* are in communication with each other, and the four-way valve 4 is set so that the first port 4*a* and the fourth port 4*d* are in communication with each other and the second port 4*b* and the third port 4*c* are in communication with each other (solid line in FIG. 1). Also, the pre-expansion valve 6 and the bypass valve 7 are set at a suitable initial degree of opening depending upon the outdoor air temperature, the room temperature and the load, and the electronic expansion valves 8*a* and 8*b* are fully opened. The electromagnetic valve 56 is closed and the electromagnetic valves 57 and 58 are opened. While the necessary depressurizing function is achieved by the expansion machine 5*a*, when a proper superheating (such as 1-10 degree Celsius) cannot be obtained at both outlet portions of the indoor heat exchangers 9*a* and 9*b*, the pre-expansion valve 6 is adjusted into the closing direction to obtain the necessary depressurization.

At this time, the high temperature and high pressure gas refrigerant (state A) discharged from the first compressor 1 passes through the electromagnetic valve 57 because of the closed electromagnetic valve 56, cooled by a certain amount at the second outdoor heat exchanger 3*b* (state B), and flows into the second compressor 5*b*. At this time the check valves 54 and 55 disposed at the outlet and inlet ports of the second outdoor heat exchanger 3*b* is closed due to the pressure difference. The refrigerant that passed the electromagnetic valve 58 and flowed into the second compressor 5*b* driven by the expansion machine 5*a*, is compressed by an amount corresponding to the power recovered at the expansion machine. At this time, the bypass valve 53 disposed in relation to the second compressor 5*b*, which is in the open state during the starting period in which no pressure difference is generated, is closed due to the pressure difference across the second compressor 5*b* when the second compressor 5*b* is driven by the expansion machine 5*a*. The refrigerant discharged from the second compressor 5*b* flows through the first port 2*a*, the second port 2*b* (state C), dissipates heat into the air or the medium to be heated in the first outdoor heat exchanger 3*a* (state D), and flows into the pre-expansion valve 6 through the second port 4*a* and the third port 4*c* of the four-way valve 4. The refrigerant (state E) regulated by the pre-expansion valve 6 as to the density at the inlet of the expansion machine 5*a* is depressurized at the expansion machine 5*a* and flows through the first port 4*a* and the fourth port 4*d* of the four-way valve 4 to pass through the liquid pipe 52 (state F). At this time, the bypass valve 7 of the expansion machine 5*a* is controlled so that the refrigerant flow rate through the second compressor 5*b* and the recovered power is in balance. Then, the refrigerant is slightly depressurized (state G) at the electronic expansion valves 8*a* and 8*b* which are depressurizing means in the indoor unit 200*a* and 200*b*, flows into the gas pipe 51 after the thermal load in the space to be air conditioned is treated by the indoor heat exchangers 9*a* and 9*b*, and then flows from the fourth port 2*d* through the third port 2*c* of the four-way valve 2 into the first compressor 1 (state H). At this time, when only one of the outlet portions out of the indoor heat exchanger 9*a* and the indoor heat exchanger 9*b* does not become the set superheating temperature (1-10 degrees Celsius), the depressurizing means 8*a* and 8*b* are adjusted so that the degrees of the outlet superheat of the inner heat exchangers 9*a* and 9*b* are equal.

Figure 3:
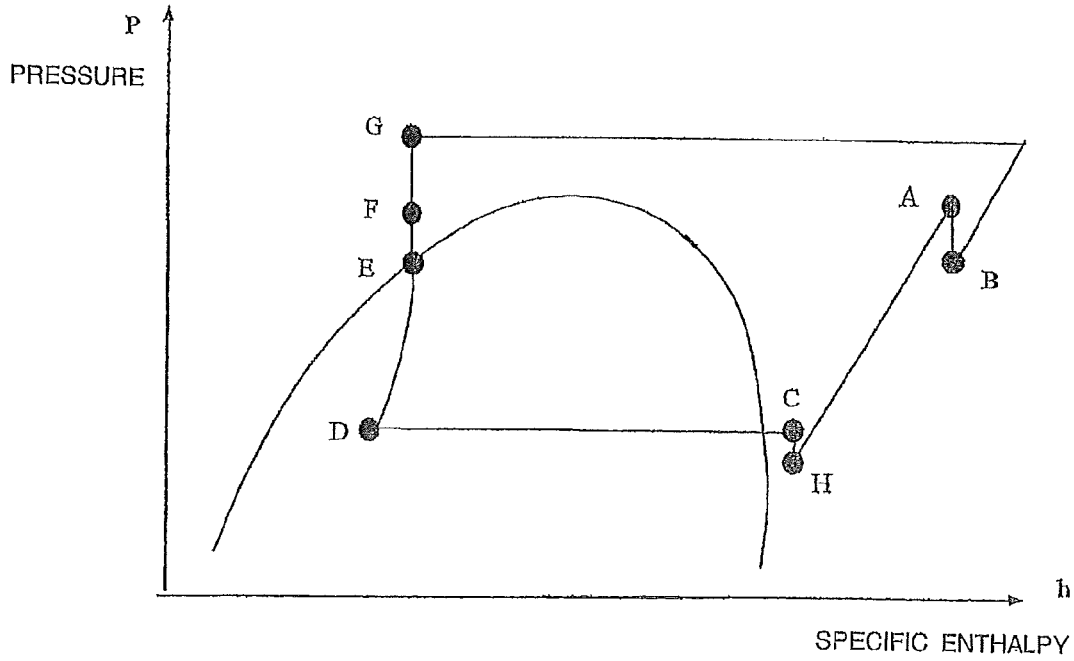
FIG. 3 is a view showing the heating operation on the P-h diagram of the refrigeration cycle device of the present invention (Embodiment 1).

The description will be made as to the heating operation on the basis of FIGS. 1 and 3. In this embodiment, while an example in which the expansion machine is used even in the heating operation will be described, since the density ratio at the inlet portion of the expansion machine 5*a* and the inlet portion of the second compressor 5*b* is large during the heating operation, the expansion power recovery loss for balancing the passing refrigerant flow rate and the recovery power. Therefore, the arrangement may be such that the four-way valve 4 is eliminated according to the necessity and that the expansion machine unit 5 is not used during the heating operation.

During the heating operation of this embodiment, the four-way valve 2 in the outdoor unit 100 is set so that the first port 2*a* and the fourth port 2*d* are in communication with each other and the second port 2*b* and the third port 2*c* are in communication with each other, and the four-way valve 4 is set so that the first port 4*a* and the second port 4*b* are in communication with each other and the third port 4*c* and the fourth port 4*d* are in communication with each other. In this case, the electronic expansion valves 8*a* and 8*b* in the indoor units 200*a* and 200*b* are fully opened, and the basic depressurizing function is achieved by the expansion machine 5 and when the amount of depressurization is insufficient, the pre-expansion valve 6 is adjusted to obtain the necessary depressurization so that a proper temperature dependent upon the room temperature is obtained at the outlet portions of the indoor heat exchangers 9*a* and 9*b*.

At this time, the high temperature and high pressure gas refrigerant (state A) discharged from the first compressor 1 passes through the electromagnetic valve 56 because of the closed electromagnetic valves 57 and 58, flows from the first port 2*a*, through the fourth port 2*d* and the gas pipe 51 and flows into the indoor units 200*a* and 200*b* after further compressed by the second compressor 5*b* (state B). The high temperature and high pressure refrigerant flowed into the indoor units 200*a* and 200*b* flows into the indoor heat exchangers 9*a* and 9*b* to radiate heat into the air in the room to heat the room and to lower its temperature (state G). This refrigerant at the medium temperature and high pressure flows through the electronic expansion valves 8*a* and 8*b* (state F) and flows into the liquid pipe 52. The refrigerant flowed into the liquid pipe 52 passes through the fourth port 4*d* and the third port 4*c* of the four-way valve 4 and flows into the pre-expansion valve 6. The refrigerant flowing out from the pre-expansion valve 6 (state E) flows into the expansion machine 5*a*, through the first port 4*a* and the second port 4*b* of the four-way valve 4 and flows into the first and the second outdoor heat exchangers 3*a* and 3*b*. At this time, the check valves 54 and 55 are brought into the open state because the pressure difference (such as 0.5 MPa) necessary for valve closing cannot be obtained. Then, the gas refrigerant (state C) evaporated in the first and the second outdoor heat exchangers 3*a* and 3*b* is returned to the suction portion (state H) of the first compressor 1 via the second port 2*b* and the third port 2*c* of the four-way valve 2.

Figure 4:
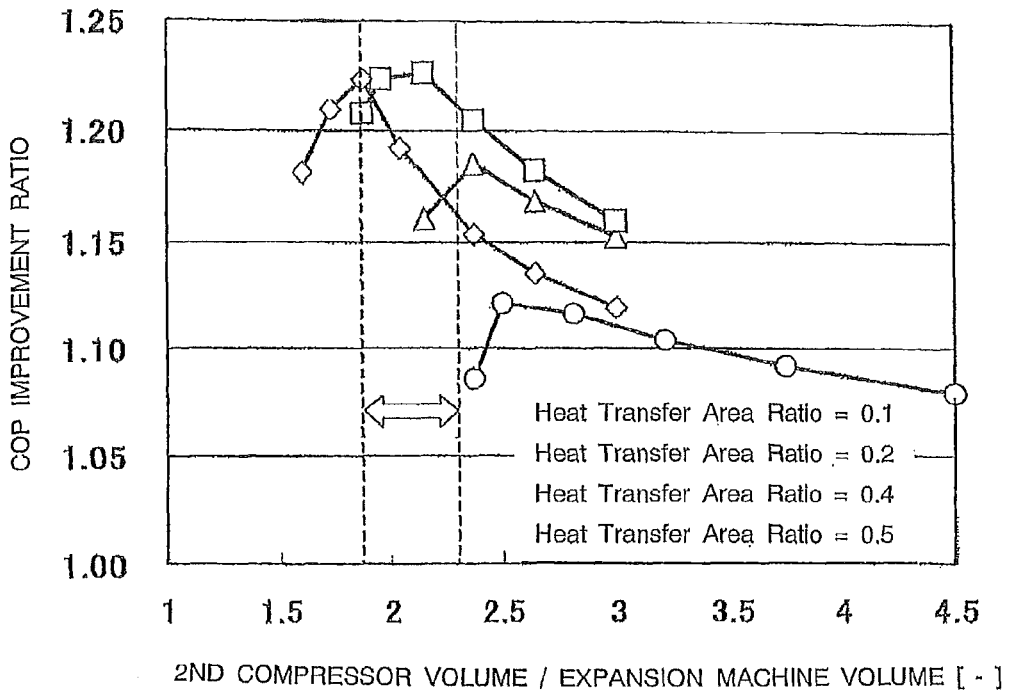
FIG. 4 is a view showing the relationship of the ratio of the volume of the second compressor and the COP improvement ratio relative to the expansion machine volume of the refrigeration cycle device of the present invention (Embodiment 1).

The heat transfer area ratio of the second outdoor heat exchanger 3*b* relative to the total heat transfer area of the outdoor heat exchanger when the air speed flowing into the outdoor heat exchanger is constant will now be described. FIG. 4 is a graph in which the ratio of the volume of the second compressor 5*b* relative to the volume of the expansion machine 5*a* (hereinafter referred to expansion compression volume ratio) is plotted against the axis of ordinate and the COP improvement ratio is plotted against the axis of abscissa, with the above mentioned heat transfer area is used as the parameter. The heat transfer area here means the ratio of the heat transfer area of the second outdoor heat exchanger 3*b* relative to the total heat transfer area of the outdoor heat exchangers, i.e., the first outdoor heat exchanger 3*a* and the second outdoor heat exchanger 3*b*. The COP improvement ratio shown on the axis of ordinate is a value for the refrigerant circuit in which the heat transfer area of the second outdoor heat exchanger 3*b* is 0.1 and an expansion machine 5*a* is not provided. A general tendency of the COP improvement ratio indicates it has a local maximal at about the expansion compression volume ratio of 2. For example, at the heat transfer area ratio of 0.4 (symbol □), it has a local maximal at about the expansion compression volume ratio of 2.1. This is because, when the expansion compression volume ratio is larger than 2.1, the second compressor volume is large and the number of rotation is decreased, so that a pre-expansion loss for increasing the rotational number is generated, and when the expansion compression volume ratio is less than 2.1, the second compressor volume is small and the number of rotation is increased, so that a bypass loss for decreasing the rotational number is generated. For the heat transfer area ratio of 0.2, the local maximal of the COP ratio, at the expansion compression volume ratio of 2.4 where the COP is at it local maximal, is lower than that where the heat transfer area is 0.4 by 4% (from 1.225 to 1.185). Therefore, it is understood that there is an expansion compression volume ratio that causes the COP improvement ratio to become the local maximal, and its value is within the range of 1.8-2.3 as shown by white arrow in FIG. 4.

Figure 5:
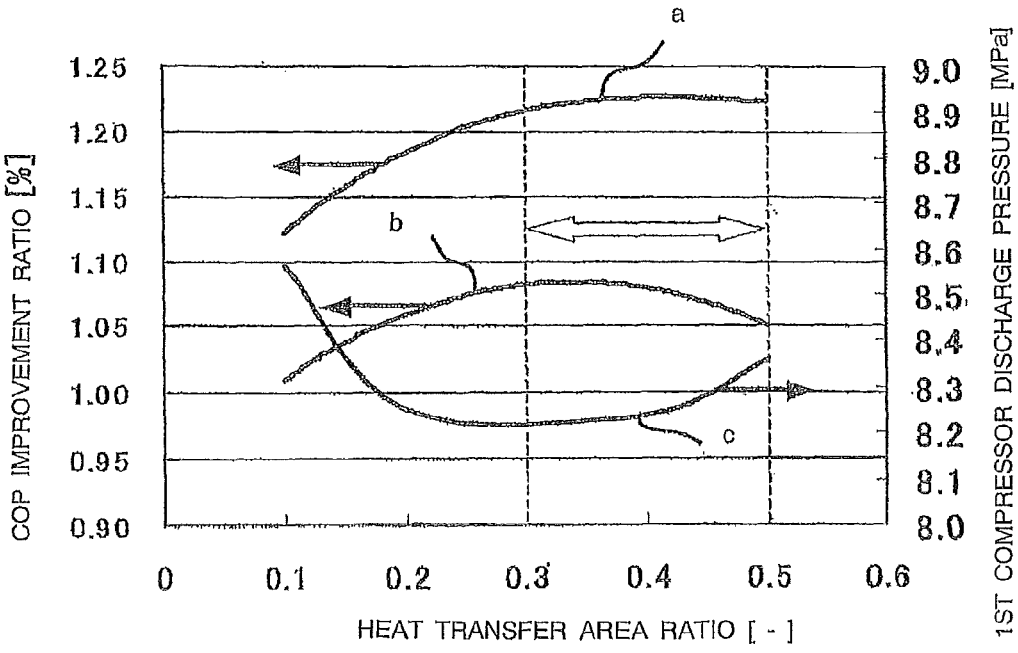
FIG. 5 is a view showing the relationship between the heat transfer area ratio and the COP improvement ratio of the refrigerant cycle device of the present invention (Embodiment 1).

FIG. 5 is graph showing the COP improvement ratio relative to the heat transfer area ratio of the second outdoor heat exchanger 3*b* when the air flow rate distribution is uniform relative to the column direction of the heat exchanger, the expansion compression volume ratio is at the optimum value shown in FIG. 4. In FIG. 5, a shows the COP improvement ratio when an expansion machine is installed, b shows the COP improvement ratio when no expansion machine is installed, and c shows the discharge pressure change of the first compressor 1 when an expansion machine is installed. When the heat transfer area ratio of the second outdoor heat exchanger 3*b* is increased, the heat exchange amount at the second heat exchanger 3*b* is increased, thereby the discharge pressure of the first compressor 1 (the suction pressure at the second compressor 5*b*), and the input of the first compressor 1 is decreased (the COP improvement ratio is increased). However, when the heat transfer area of the second outdoor heat exchanger 3*b* is increased too much, the heat exchange amount that should be handled at the second outdoor heat exchanger 3*b* increases, whereby the discharge pressure of the first compressor 1 turns into increase and the input is increased. Therefore, it is understood that there is an optimum value of the heat transfer area ratio of the second outdoor heat exchanger 3*b* that makes the COP improvement ratio local maximal, the value is within the range of from 0.3-0.5 as shown in white arrow in FIG. 5, and that the advantageous effect is significantly decreased at less than 0.3. It is understood from the above, that the second outdoor heat exchanger 3*b* is arranged to have a heat transfer area ratio of 0.3-0.5 and an expansion compression volume ratio of 1.8-2.3, the performance of the expansion machine installed circuit can be fully utilized.

As for the heat transfer area ratio, the range of 0.3-0.5 is the most preferable and the range of 0.2-0.6 is preferable, but the COP improvement ratio is not sufficiently high when the heat transfer area ratio is less than 0.2 and the heat transfer area ratio larger than 0.6 is not practical. As for the expansion volume ratio, the range of 1.8-2.3 is the most preferable and the range of 1.5-2.5 is preferable, but the COP improvement ratio is not sufficiently high irrespective of the heat transfer area ratio when its is less than 1.5 and the COP improvement ratio does not become high even if it is larger than 2.5.

Figure 6:
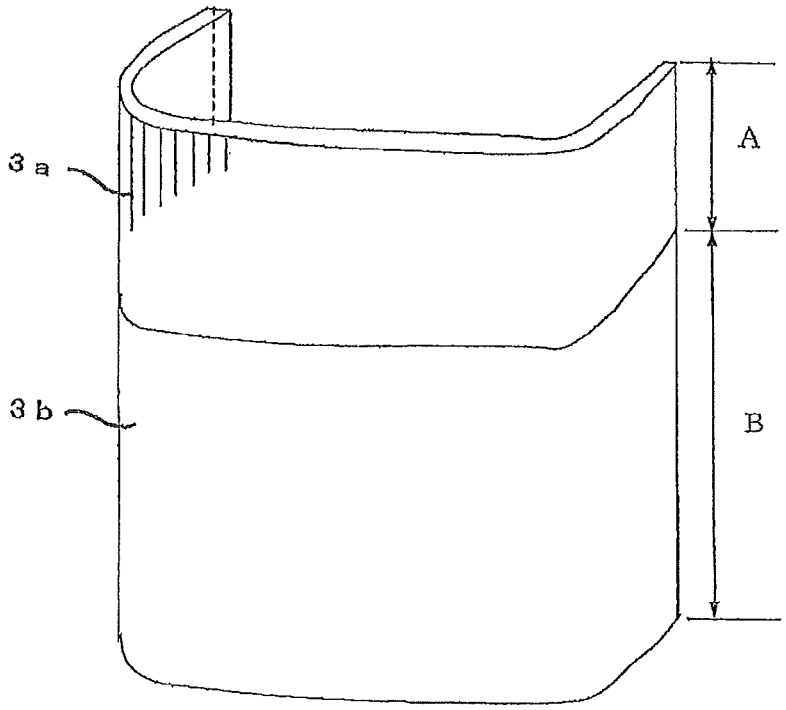
FIG. 6 is a view showing the structure of the outdoor heat exchanger of the refrigerant cycle device of the present invention (Embodiment 1).

While FIG. 1 illustrates an example in which the first outdoor heat exchanger 3*a* and the second outdoor heat exchanger 3*b* is separated, this is not limiting, but the arrangement may be such that, as shown in FIG. 6, the first outdoor heat exchanger 3*a* in section A in the upper stage is utilized as an intermediate cooler, and the second outdoor heat exchanger 3*b* in section B in the lower stage is utilized as the main heat radiator, and that the ratio of the section A to the section B is 4:6. Also, as shown in FIG. 1, the arrangement may also such that the outdoor heat exchanger is divided in the row direction, the air shown by the while arrow flows from right to left, so that the air first comes in contact with the second outdoor heat exchanger 3*b* and then the air comes in contact with the first outdoor heat exchanger 3*a*. Further, these first and the second outdoor heat exchangers may be arranged into an integral structure.

Also, in this embodiment, the arrangement is such that the ratio of the heat transfer area of the second outdoor heat exchanger relative to the total heat transfer area of the outdoor heat exchangers is determined by only the performance during the cooling operation. The above-mentioned heat transfer area ratio can be determined only upon the performance during the cooling operation because, when the outdoor heat exchanger is utilized as an evaporator during the heating operation, the enthalpy difference between the suction air and the refrigerant temperature corresponding saturated moisturized air (in the evaporator, the heat exchanger is in the moisturized state, so that the driving temperature difference in the heat exchanging is the enthalpy difference) is small, so that the effect of the heat transfer area ratio on the performance is small.

Figure 7:
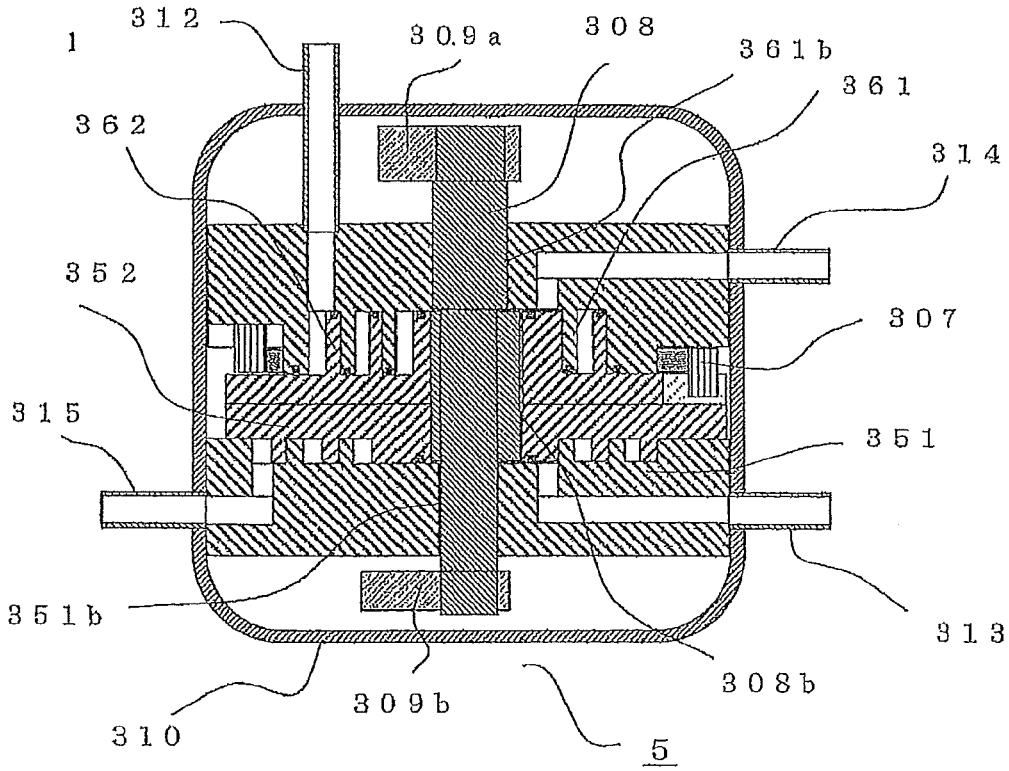
FIG. 7 is a view showing a section of the second compressor integral type expansion machine of the of the refrigerant cycle device of the present invention (Embodiment 1).

The detailed structure of the expansion machine unit 5 is shown in FIG. 7. FIG. 7 shows the expansion machine unit in which the expansion machine 5*a* and the second compressor 5*b* are both of the scroll structure, the expansion machine 5*a* is composed of an expansion machine stationary scroll 351 and an expansion machine orbiting scroll 362, and the second compressor 5*b* is composed of a second compressor stationary scroll 361 and a second compressor orbiting scroll 362. These scrolls have penetrated therein at the central portion a shaft 308, and the shaft 308 is provided at its both ends with balance weights 309*a* and 309*b*, and the shaft 308 is supported by an expansion machine side bearing portion 351*b* and the second compressor side bearing portion 361*b*. Also, the expansion machine side scroll 352 of the orbiting scroll and the second compressor mechanism side scroll 362 have a back-to-back structure or have a base plate in common to provide an integral structure. Also, a crank portion 308*b* for eccentrically drive the orbiting scroll and an Oldham ring 307 for regulating the position are provided all within a hermetic vessel 310.

In the expansion machine unit 5 having the above-described structure, when the motion space for the orbiting scroll is made at the low pressure atmosphere after expansion, an urging force is generated from the second compressor 5*b* to the expansion machine side. At this time, when the expansion compression volume ratio is designed to be high (equal to or more than 2.3, for example), a thrust load from the side of the second compressor 5*a* becomes large with the same tooth height, so that the thrust load from the side of the expansion machine 5*a* becomes excessively small with respect to the thrust load from the second compressor 5*b*, the thrust load from both sides cannot be offset, resulting in a difficult structure of the expansion machine unit 5 in which the second compressor 5*b* and the expansion machine 5*a* are integrally combined. Also, the scroll at the side of the second compressor 5*b* may have an extremely high tooth in order to reduce the thrust load on the side of the second compressor 5*b*, but a problem of strength generates in this case. Therefore, in an expansion machine unit having the expansion machine 5*a*, the second compressor 5*b* as well as the scroll structure, the expansion compression volume ratio is set equal to or less than 2.3, whereby a reliable expansion unit that cope with not only the balance between the passing refrigerant flow rate and the power but also the balance between the thrust loads.

Figure 8:
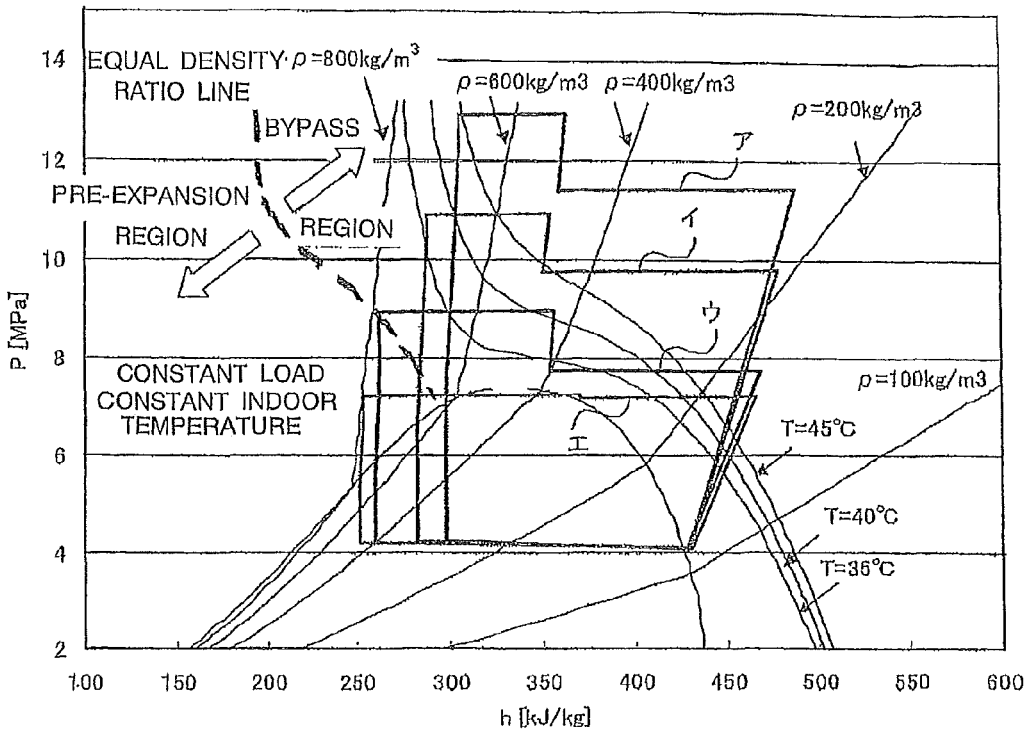
FIG. 8 is a view showing the operation on the P-h diagram of the refrigerant cycle device of the present invention when the outdoor temperature is changed (Embodiment 1).

The description will now be made as to the control method of the expansion machine 5*a*. In this embodiment, pre-expansion valve disposed in series with the expansion machine 5*a* at the inlet portion of the expansion machine 5*a* and the bypass valve 7 provided for bypassing the expansion machine 5*a* are used to control the expansion machine 5*a* so that the flow rate passing through the expansion machine 5*a* and the recovered power as well as the flow rate passing through the second compressor 5*b* and the recovered power are equal to each other. This control method will be explained in conjunction with FIG. 8. FIG. 8 is a P-h diagram showing the change in the operational state when the outdoor temperature is changed under the conditions that the cooling load is constant and the indoor temperature is constant. In the figure, curves with fixed density ρ and the curves with the fixed temperature T are shown, and an equal density ratio line along which the ratio of the expansion machine inlet density relative to the second compressor inlet density is equal to 2 is shown in broken line. Separated by this equal density ratio line as a boundary, the upper right region of this line shows a bypass region in which the density ratio of the expansion/compression is low (expansion machine density is low), and the lower left region of this line shows a pre-expansion region in which the density ratio of the expansion/compression is high (expansion machine density is high).

For example, suppose that the present operation state of the refrigerant cycle is as at a in FIG. 8, then the operation state of the refrigeration cycle is changed into b when the outdoor temperature increased. At this time, as the outdoor temperature increases, the heat radiator outlet temperature increases and the inlet density of the expansion machine 5*a* decreases (the ratio of the inlet density of the expansion machine 5*a* relative to the suction density of the second compressor 5*b* is decreased). Therefore, when the pre-expansion valve 6 is not in the fully open state, the pre-expansion valve 6 is opened to increase the inlet pressure and to increase the inlet density of the expansion machine 5*a*, thereby to decrease the rotational number of the expansion machine 5*a*. When the pre-expansion valve 6 is fully opened, the bypass valve 7 is opened to decrease the refrigerant flow rate flowing through the expansion machine 5*a* and to similarly decrease the rotational number. At this time, since the rotational number of the second compressor 5*b* coaxially connected to the expansion machine 5*a* is also decreased, the inlet pressure of the second compressor 5*b* is increased to satisfy the condition of a constant refrigerant flow rate. Also, when the pre-expansion valve 6 of the expansion machine 5*a* is opened, the recovered power increases, so that the suction pressure and the discharge pressure of the second compressor 5*b* are both increased. While the recovered power of the expansion machine 5*a* decreases when the bypass valve is opened, comparing the amount of increase of the suction pressure of the second compressor 5*b* and the amount of decrease of the discharge pressure due to the decrease in the recovered power, the amount of increase of the suction pressure of the second compressor 5*b* is greater due to the refrigerant property, thus resulting in the increase in the discharge pressure. In the manner described above, the rotational number is decreased, thus balancing the refrigerant flow rate flowing through the expansion machine 5*a* and the second compressor 5*b* and the recovery power, regulating the outlet temperature of the first outdoor heat exchanger 3*a* to a predetermined value.

On the other hand, it is now assumed that the present operational state of the refrigeration cycle is as shown by b in FIG. 8, for example, the operational state of the refrigeration cycle changes into c. At this time, the heat radiator outlet temperature decreases as the outdoor temperature decreases and the expansion machine inlet density increases (the ratio of the suction density of the expansion machine 5*a* relative to the inlet density of the second compressor 5*b* increases). Therefore, when the bypass valve 7 is not in the fully closed state, the bypass valve 7 is closed to increase the flow rate flowing through the expansion machine 5*a* to increase the rotational number of the expansion machine 5*a*. When the bypass valve 7 is fully closed, pre-expansion valve 6 is closed to decrease the inlet pressure to decrease the inlet density of the expansion machine 5*a* and to similarly increase the rotational number. At this time, since the rotational number of the second compressor 5*b* coaxially connected to the expansion machine 5*a* is also increased, the suction pressure of the second compressor 5*b* is decreased to satisfy the condition of a constant refrigerant flow rate. Also, when the pre-expansion valve 6 of the expansion machine 5*a* is closed, the suction pressure and the discharge pressure are both decreased because the recovered power decreases. While the recovered power of the expansion machine 5*a* decreases when the bypass valve of the expansion machine 5*a* is closed, comparing the amount of decrease of the suction pressure of the second compressor 5*b* and the amount of increase of the discharge pressure due to the increase in the recovered power, the amount of decrease of the suction pressure of the second compressor 5*b* is greater due to the refrigerant property, thus resulting in the decrease in the discharge pressure. In the manner as described above, the rotational number is decreased, thus balancing the refrigerant flow rate flowing through the expansion machine 5*a* and the second compressor 5*b* and the recovery power, regulating the outlet temperature of the first outdoor heat exchanger 3*a* to a predetermined value.

When the outdoor temperature is extremely low, the power recovery effect (the compression power for the second compressor 5*b*) is small as shown at d in FIG. 8, the necessary pressure decrease may be obtained by the bypass valve 7 alone with the pre-expansion valve 6 fully closed.

As above described, when the outdoor temperature is increased, the bypass region for decreasing the rotation number of the expansion machine 5*a* is provided, and when the outdoor temperature is decreased, the pre-expansion region for increasing the rotational number of the expansion machine 5*a* is provided. Generalizing this, the equal density ratio line shown in the broken line in FIG. 8 is being used as the boundary, when the ratio of the inlet density of the expansion machine relative to the suction density of the second compressor 5*b* high, the operation is performed in the bypass region as shown by the white arrow pointing in the upper right direction, and when the above density ratio is low, the operation is performed in the pre-expansion region as shown by the white arrow pointing in the left low direction. This operation is similarly achieved also when the indoor temperature and the air conditioning load is changed.

Figure 9:
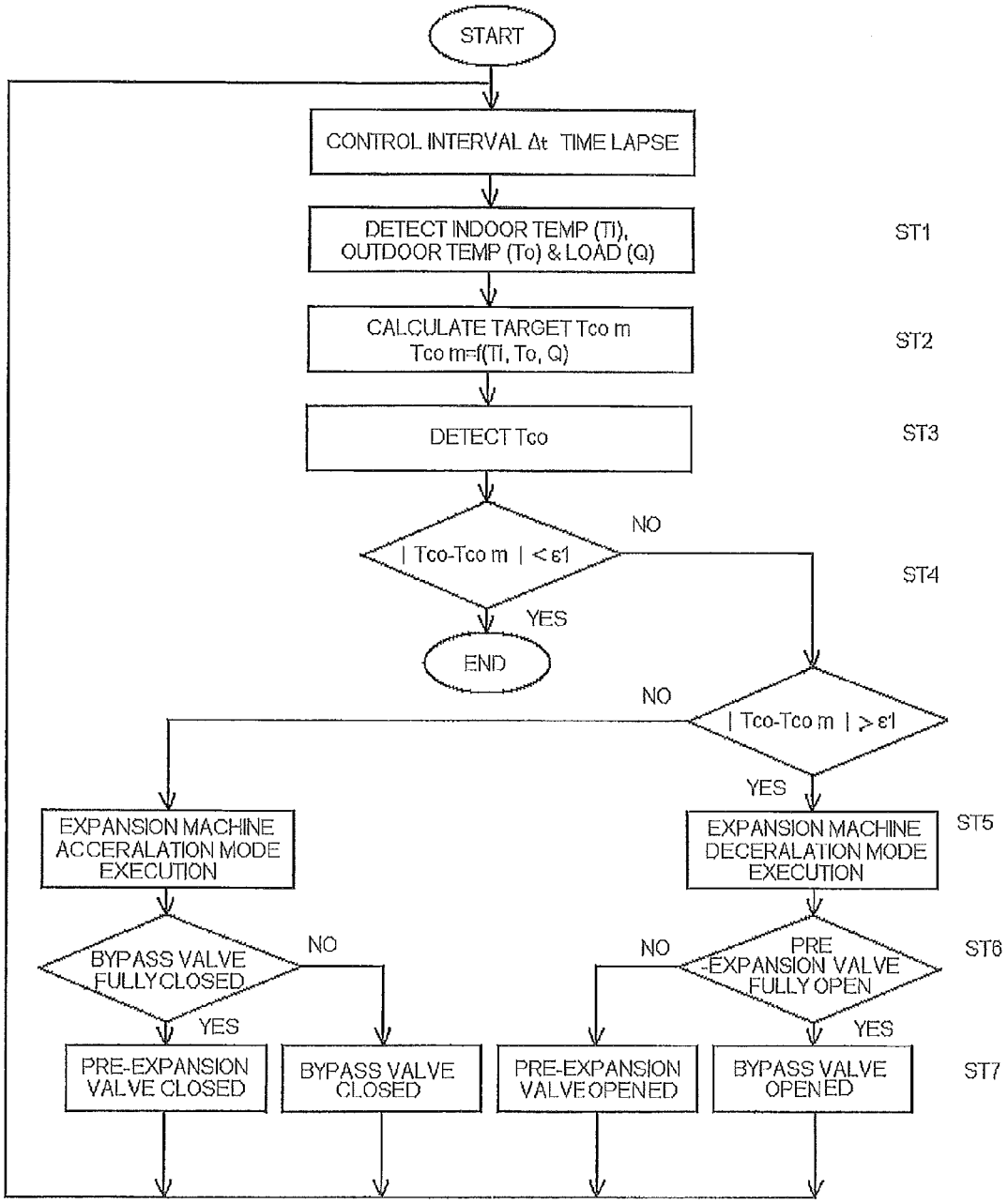
FIG. 9 is a view showing the flow chart of the expansion machine control method of the refrigeration cycle device of the present invention (Embodiment 1).

A concrete control algorithm will now be described in conjunction with FIGS. 1 and 9. As shown in FIG. 9, the indoor temperature (Ti), the outdoor temperature (To) and the air conditioner load (Q) are detected at ST1, and basing on these values the inlet target temperature Tco m of the pre-expasion valve 6 is calculated at ST2. The air conditioner load Q can be assumed on the basis of the indoor temperature, the outdoor temperature, the compressor frequency and the like. At ST3, the inlet temperature Tco of the pre-expansion valve 6 is detected and when the difference between the inlet temperature Tco and the inlet target temperature Tco m is greater than $\epsilon 1$($\epsilon 1$ is a positive value) (ST4), the expansion machine deceleration mode is carried out (ST5). In this case, if the pre-expansion valve 6 is not fully opened (ST6), the pre-expansion valve 6 is opened (ST7), and if the pre-expansion valve 6 is fully opened (ST6), the bypass valve 7 is opened (ST7).

On the other hand, when the difference between the inlet temperature Tco and the inlet target temperature Tco m is smaller than $-\epsilon 1$($\epsilon 1$ is a positive value) (ST4), the expansion machine acceleration mode is carried out (ST5). In this case, if the bypass valve 7 is not fully closed (ST6), the bypass valve 7 is closed (ST7), and if the bypass valve 7 is fully closed (ST6), the pre-expansion valve 6 is closed (ST7).

Thus, the rotational number of the expansion machine unit 5 is increased or decreased to make the inlet temperature of the pre-expansion valve 6 equal to the inlet target value Tco m. At this time, when the absolute value of the difference between the inlet temperature Tco and the inlet target temperature Tco m become less than $\epsilon 1$, the control is completed. While an example is explained in which the inlet temperature Tco of the pre-expansion valve 6 is controlled to the inlet target value, this is not limiting but the discharge temperature Td of the first compressor 1 or the second compressor 5*b* is detected and the control may be carried out so that the Td is used as the target value or the difference $\Delta$Tc between Td and Tco is used as the target value. Also, the pressure sensor may be disposed at the discharge portion of the first compressor 1 or the second compressor 5*b* and the control may be carried out so that the detected pressure is made equal to the target value.

While in this embodiment, the four-way valve 4 is used to utilize the expansion machine for both the cooling operation and the heating operation, the arrangement may be such that the expansion machine 5*a* is used only during the cooling operation. In this case, the second port 4*b* and the third port 4*c* as well as the first port 4*a* and the fourth port 4*d* of the four-way valve 4 are respectively connected so that the four-way valve 4 is not necessary. At this time, a refrigeration circuit for recovering the power using the expansion machine 5*a* is constituted during the cooling operation, and a refrigeration circuit for not recovering the power using the bypass valve of the expansion machine 5*a* during the heating operation.

Also, while the expansion machine 5*a* in this embodiment has the structure as shown in FIG. 7, this is not limiting, but the arrangement may be such that a pressure relief valve disposed in a pipe for bypassing the expansion mechanism inlet and outlet port portion inside the expansion machine 5*a* is relieved when the pressure difference across the expansion machine 5*a* is equal to or greater than a predetermined value. In this case, when the pressure difference is equal to or more than the predetermined value, the relief valve is opened, so that an amount of passing refrigerant flow corresponding to the pressure difference bypasses the expansion element, making an electronic expansion valve disposed externally of the expansion machine 5*a* is not necessary.

From the above, it is understood that a refrigeration cycle device is obtained in which the second compressor 5*b* and the first compressor 1 are connected in series, the second heat source side heat exchanger 3*b* is disposed between the first compressor 1 and the second compressor 5*b*, and in which the operation is carried out utilizing the first heat source side heat exchanger 3*a* and the second heat source side heat exchanger 3*b* irrespective of the operational mode.

By arranging the heat transfer area ratio of the second outdoor heat exchanger relative to the total heat transfer area of the outdoor heat exchanger to be 0.3-0.5, and the ratio of the expansion machine volume and the volume of the second compressor 5*b* driven by the expansion machine (the expansion compression volume ratio) to be 1.8-2.3, the refrigeration machine can be provided in which the expansion machine can be effectively utilized and a high performance is exhibited. Particularly, when the expansion machine and the second compressor both have the scroll type structure and when the expansion compression volume ratio is high, a structural difficulty arises that the tooth height of the second compressor side scroll becomes extremely high in order to decrease the thrust load on the second compressor side, so that limiting the expansion compression volume ratio to less than 2.3 is effective to improve the reliability. Also, by detecting the inlet temperature of the pre-expansion valve and the discharge temperature of the second compressor driven by the expansion machine, and controlling the degrees of opening of the pre-expansion valve and the bypass valve on the basis of these detected values, the passing refrigerant flow rate flowing through the expansion machine and the recovered power can be regulated to efficiently utilize the expansion machine.

[Embodiment 2]

Figure 10:
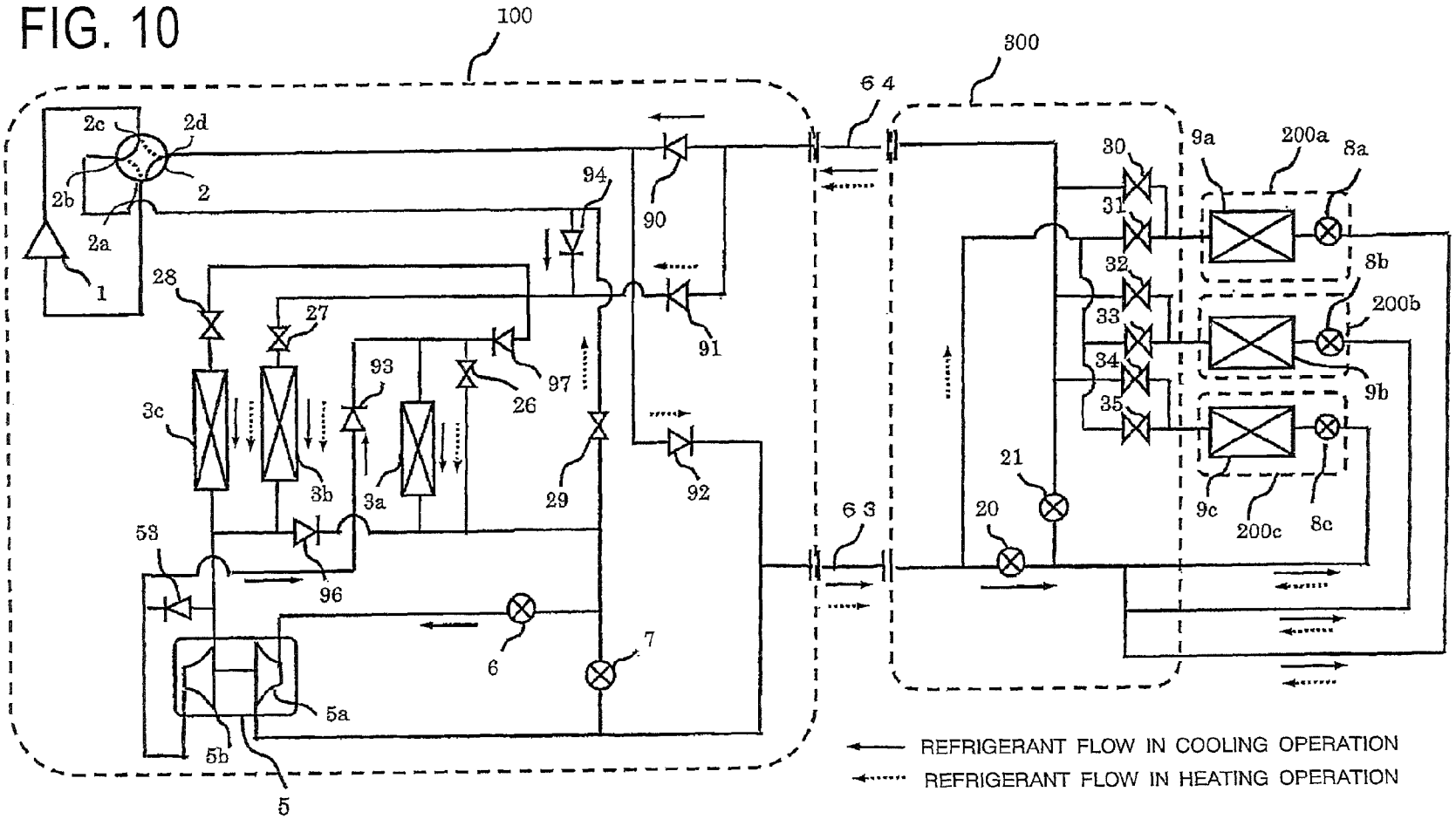
FIG. 10 is a view showing the construction of the refrigerant cycle device of the present invention (Embodiment 2).

The refrigeration cycle device according to the second embodiment of the present invention will now be described. FIG. 10 is schematic diagram showing the refrigeration cycle device according the second embodiment of the present invention, which is different from the first embodiment is that the cooling operation and the heating operation can be selected for each of the indoor units and that the outdoor heat exchanger is divided into three sections. In FIG. 10, the refrigerant cycle device according to this embodiment comprises the outdoor unit 100 including therein the first outdoor heat exchanger 3*a*, the second outdoor heat exchanger 3*b* and the third outdoor heat exchanger 3*c*, the indoor units 200*a*, 200*b* and 200*c* including the indoor heat exchangers 9*a*, 9*b* and 9*c*, the shunt unit 300 for controlling the shunted state of the refrigerant, and a high pressure pipe 63 and a low pressure pipe 64 connecting the outdoor unit 100 and the shunt unit 300. This cycle contains carbon dioxide which becomes the supercritical state at a critical temperature (about 31 degree Celsius) as the refrigerant.

The outdoor unit 100 disposed outdoor comprises the first compressor 1 for compressing the refrigerant gas, a four-way valve 2 or a first refrigerant flow path change over means for changing the flow direction of the refrigerant according to the operational mode, the first outdoor heat exchanger 3*a*, the second outdoor heat exchanger 3*b* and the third outdoor heat exchanger 3*c* serving as a condenser or an evaporator according to the operational mode, the expansion machine unit 5 in which the expansion machine 5*a* and the second compressor 5*b* are integrally combined, and an unillustrated blower for forcedly supplying an air flow to the outer surface of the outdoor heat exchangers 3*a*, 3*b* and 3*c*. The expansion machine unit 5 has disposed therein the expansion machine 5*a* and the second compressor 5*b*, which are coaxially connected together. The second compressor 5*b* has disposed therein a bypass circuit, which has a bypass valve 53 or a check valve disposed therein as an-on off valve. In order to balance the flow rate and the power of the expansion machine 5*a* and the second compressor 5*b*, the expansion machine 5*a* is provided with, in series, the on-off valve 6 (hereinafter referred to also as pre-expansion valve) which is an electronic expansion valve which is an on-off means capable of changing the degree of opening, and with, in parallel, the on-off valve 7 (hereinafter referred to also as the bypass valve) which is an electronic expansion valve. Also, in order to flow the refrigerant in the high pressure pipe 63 and the low pressure pipe 64 in the same direction, check valves 90, 91 and 92 for example are disposed as on-off valves, and in order to change over between the cooling operation and the heating operation, a check valve 94 and an electromagnetic valve 29 are disposed as on-off valves. Also, in order to control the flow of the refrigerant into the first outdoor heat exchanger 3*a*, the second outdoor heat exchanger 3*b* and the third outdoor heat exchanger 3*c*, the electromagnetic valves 26, 27 and 28 are disposed as on-off valves, and the check valves 93, 96 and 97 are disposed for preventing counter flow during the cooling operation.

The shunt unit 300 contains therein the electronic expansion valves 20 and 21 which are depressurizing device and the electromagnetic valves 30-35 which are on-off valves.

The indoor units 200*a*, 200*b* and 200*c* respectively comprises the indoor heat exchangers 9*a*, 9*b* and 9*c*, the electronic expansion valves 8*a*, 8*b* and 8*c* which are depressurization means capable of changing the degree of opening for adjusting the refrigerant distribution to each indoor heat exchanger, unillustrated blowers for forcedly supplying the indoor air to the outer surfaces of the respective indoor heat exchangers, and the piping for connecting the above elements. The indoor heat exchangers 9*a*, 9*b* and 9*c* each has one end directly connected to the shunt unit 300, and the other end connected to the shunt unit 300 via the electronic expansion valves 8*a*, 8*b* and 8*c*. While there are three indoor units are provided in this embodiment, two or more than four units may equally be provided.

The operation of the refrigeration cycle device as above construction will now be described. The refrigerant cycle device in this embodiment has four operation modes of the full cooling operation, the full heating operation, the cooling dominant operation and the heating dominant operation. First the full cooling operation in which the expansion machine unit 5 is utilized to recover power will be described in conjunction with FIG. 10. In the full cooling operation, the four-way valve 2 in the outdoor unit 100 is set so that the first port 2*a* and the fourth port 2*d* communicate with each other and the third port 2*c* and the second port 2*b* communicate with each other (solid line in FIG. 10). The electronic expansion valves 8*a*, 8*b* and 8*c* in the indoor units are fully closed. The electronic expansion valve 20 is fully opened and 21 is fully closed. The necessary depressurizing function is realized by the expansion machine 5*a*, but when a proper super heating (5-10° C., for example) cannot be obtained at the outlet portions of any of the indoor heat exchangers 9*a*, 9*b* and 9*c*, the pre-expansion valve 6 is adjusted in the closing direction to obtain the necessary depressurization.

In the full cooling operation, the heat radiation amount of the respective discharged refrigerant from the first compressor 1 and the second compressor 5*b* can be adjusted by opening and closing of the electromagnetic valves 26, 27 and 28 in the indoor unit 100, the description in this embodiment will be made as to where the electromagnetic valves 27 and 28 are opened and the electromagnetic valve 26 is closed. The electromagnetic valve 29 is closed. The electronic expansion valve 20 in the shunt unit 300 is fully opened, the valve 21 is fully closed, the electromagnetic valves 30, 32 and 34 are set in the open state, and the electromagnetic valves 31, 33 and 35 are set in the closed state. At this time, the high temperature, high pressure gas refrigerant discharged from the first compressor 1 flows from the third port 2*c* of the four-way valve 2 via the second port 2*b* and into the check valve 94 because the electromagnetic valve 29 is closed. The refrigerant that passes through the check valve 94 flows through the electromagnetic valves 27 and 28 because the check valve 97 is closed due to the pressure difference by the second compressor 5*b*, flows through the second outdoor heat exchanger 3*b* and the third outdoor heat exchanger 3*c* in parallel to radiate heat therein, and the flow joins at the heat exchanger outlet portion. The joined refrigerant flows into the second compressor 5*b* driven by the recovered power of the expansion machine 5*a* because the check valve 96 is closed due to the pressure difference at the second compressor. The refrigerant flowed into the second compressor 5*b* is compressed by an amount corresponding to the power recovered by the expansion machine 5*a*.

The bypass valve 53 disposed in the second compressor 5*b* is opened during the start up when there is no pressure difference, but is closed due to the pressure difference when the second compressor 5*b* is driven by the power recovered by the expansion machine 5*a*.

The refrigerant discharged form the second compressor 5*b* passes through the check valve 93, radiates heat to the air which is the medium to be heated by the first outdoor heat exchanger 3*a*, distributed to the pre-expansion valve 6 and the bypass valve 7 due to the closed electromagnetic valve 29. The refrigerant regulated by the pre-expansion valve 6 in terms of the inlet density at the expansion machine 5*a* is depressurized by the expansion machine 5*a* and joined to the refrigerant depressurized by the bypass valve 7, and passes through the high pressure pipe 63 because the check valve 92 is closed. At this time, the bypass valve 7 of the expansion machine 5*a* is controlled so that the refrigerant flow rate passing through the second compressor 5*b* and the recovered power are balanced with each other. Thereafter, the refrigerant flows into the shunt unit 300, passes through the electronic expansion valve 20 and the distribution flow rate ratio to each heat exchangers is adjusted by the electronic expansion valves 8*a*, 8*b* and 8*c* in the indoor units 200*a*, 200*b* and 200*c*, and after processing the thermal load in the space to be air-conditioned by the indoor heat exchangers 9*a*, 9*b* and 9*c*, flows into the low pressure pipe 64 via the electromagnetic valves 30, 32 and 34, and flows into the first compressor 1 through the fourth port 4*d* and the first port 4*a* of the four-way valve 2. As has been described, in this embodiment, during the full cooling operation, the power recovery is achieved by the expansion machine 5*a* and the operation is carried out in the two-stage compression cycle utilizing the second compressor 5*b*.

Then, the full heating operation will be explained in conjunction with FIG. 10. In the full heating operation in this embodiment, the expansion machine 5*a* is not used, so that the pre-expansion valve 6 and the bypass valve 7 are closed. Also, although the number of the outdoor heat exchangers 3*a*, 3*b* and 3*c* that serve as evaporators can be adjusted by the open and close operation of the electromagnetic valves 26, 27 and 28 of the outdoor unit 100, in this embodiment, the explanation will be made as to where the electromagnetic valves 27 and 28 are opened and the electromagnetic valve 26 is closed. At this time, the electromagnetic valve 29 is opened. Also, the electronic expansion valve 20 in the shunt unit 300 is set fully closed, the valve 21 is set fully opened, the electromagnetic valves 31, 33 and 35 are set in the open state, and the electromagnetic valves 30, 32 and 34 are set in the closed state.

In the full heating operation in this embodiment, the four-way valve 2 in the outdoor unit 100 is set so that the first port 2*a* and the second port 2*b* communicate with each other and the third port 2*c* and the fourth port 2*c* communicate with each other. In this case, the depressurizing function is realized by the electronic expansion valves 8*a*, 8*b* and 8*c*.

At this time, the refrigerant compressed by the first compressor 1 to the supercritical state at the high temperature and high pressure state flows into the shunt unit 300 from the third port 2*c* to the fourth port 2*d* of the four-way valve 2 via the check valve 92 and the high pressure pipe 63 because the check valve 90 is closed. The refrigerant flowed into the shunt unit 300 passes through the electromagnetic valves 31, 33 and 35 and flows into the indoor units 200*a*, 200*b* and 200*c* because the electronic expansion valve 20 is closed. The high temperature high pressure refrigerant flowed into each of the indoor units flows into the indoor heat exchangers 9*a*, 9*b* and 9*c* to radiates heat to the indoor air to heat the room to decrease the temperature. This refrigerant at the intermediate temperature and high pressure is depressurized by the electronic expansion valves 8*a*, 8*b* and 8*c* and flows into the low pressure pipe 64 via the electronic expansion valve 21. The refrigerant passes through the low pressure pipe 64 flows into the electromagnetic valves 27 and 28 and the check valve 97. The refrigerant flowed into the electromagnetic valves 27 and 28 and the check valve 97 flows in parallel through the first to the third outdoor heat exchangers 3*a*, 3*b* and 3*c* and evaporates therein because the check valve 93 is closed due to the pressure difference in the outdoor heat exchanger. The refrigerant evaporated in the second outdoor heat exchanger 3*b* and the third outdoor heat exchanger 3*c* joins together at the heat exchanger outlet portion, passes through the check valve 96 to be joined together with the refrigerant flowing out from the first outdoor heat exchanger 3*a* and flows into the electromagnetic valve 29. The refrigerant passed through the electromagnetic valve 29 is returned to the suction side of the first compressor 1 via the second port 2*b* and the first port 2*a* of the four-way valve 2 because the check valve 94 is closed due to the pressure difference in the outdoor heat exchanger.

In the cooling dominant operation, the depressurization by the expansion machine 5*a* is not carried out because the high temperature high pressure gas is needed to be supplied to the indoor unit required to carry out the heating operation. That is, in this case, the operation is carried out with the four-way valve 2 in the same connection position as in the cooling operation and with the bypass valve 7 of the expansion machine 5*a* fully opened. In this embodiment, the description will be made in terms of the case where the indoor unit 200*a* is required to achieve the heating operation, and the remaining two indoor units 200*b* and 200*c* are required to achieve the cooling operation. Also, the cooling dominant operation in which the electromagnetic valve 27 is opened and the electromagnetic valves 26, 28 and 29 are closed will be explained. At this time, the electronic expansion valves 20 and 21 are set to be closed, the electromagnetic valves 30, 33 and 35 are set in the closed state and the electromagnetic valves 31, 32 and 34 are set in the open state. The gas refrigerant at a high temperature and a pressure flows from the third port 2*c* via the second port 2*b* of the four-way valve 2 into the check valve 94 because the electromagnetic valve 29 is closed. The refrigerant passed through the check valve 94 passes through the electromagnetic valve 27 and the check valve 97 because the electromagnetic valve 28 is closed, and the refrigerant passed through the check valve 97 flows into the first outdoor heat exchanger 3*a* and radiate heat therein because the electromagnetic valve 26 and the check valve 93 are closed. On the other hand, the refrigerant that dissipated heat in the second indoor heat exchanger 3*b* flows through the check valve 96 and joins to the refrigerant that dissipated heat in the first outdoor heat exchanger 3*a* and passes through the fully opened bypass valve 7 and flows into the high pressure pipe 63 because the electromagnetic valve 29 and the pre-expansion valve 6 are closed.

Thereafter, the refrigerant flows into the shunt unit 300 from which the refrigerant shunted at the electronic expansion valve 20 inlet portion is supplied to the indoor unit 200*a* where the heating operation is required and the other refrigerant is supplied to the indoor units 200*b* and 200*c* where the cooling operation is required. The refrigerant passed through the electromagnetic valve 31 flows into the indoor unit 200*a* where the heating operation is required and dissipates heat in the indoor heat exchanger 9*a* and depressurized to an intermediate pressure in the electronic expansion valve 8*a*. The indoor units 200*b* and 200*c* where the cooling operation is required receive the supply of the refrigerant that passed through the electronic expansion valve 8*a*. Thereafter, the electronic expansion valves 8*b* and 8*c* regulate the distribution flow rate ratio for each heat exchanger and, after the thermal load in the space to be air-conditioned is processed in the indoor heat exchangers 9*b* and 9*c*, the refrigerant flows into the low pressure pipe 64 via the electromagnetic valves 32 and 34, and flows into the first compressor 1 via the check valve 90, the fourth port 2*d* to the first port 2*a* of the four-way valve 2.

Thus, in this embodiment, the power recovery by the expansion machine 5*a* is not performed during the cooling dominant operation.

In the heating dominant operation, the high temperature and high pressure gas must be supplied to the indoor unit where the heating operation is required, so that the depressurization by the expansion machine 5*a* is not performed and the pre-expansion valve 6 and the bypass valve 7 are closed. The connection state of the four-way valve 5*a* for the heating dominant operation is similar to that of the heating operation. In this embodiment, the description will be made as the case where the cooling operation is required at the indoor unit 200*a* and the heating operation is required at the remaining two indoor units 200*b* and 200*c*. Also the heating dominant operation where the electromagnetic valves 27 and 29 are opened and the electromagnetic valves 26 and 28 are closed will be described. At this time, the electronic expansion valve 21 in the shunt unit 300 is set at a degree of opening for providing a proper pressure difference thereacross, the electromagnetic valves 30, 33 and 35 are set in the opened state, and the electromagnetic valves 31, 32 and 34 and the electronic expansion valve 20 are set in the closed state. The gas refrigerant at a high temperature and a high pressure discharged from the first compressor 1 flows through the third port 2*c* and the fourth port 2*d* to flow into the check valve 92 because the check valve 90 is closed. The refrigerant flowed through the check valve 92 flows into the high pressure pipe 63 because the pre-expansion valve 6 and the bypass valve 7 are closed.

Thereafter, the refrigerant flows into the shunt unit 300 and the refrigerant shunt at the inlet portion of the electronic expansion valve 20 is supplied to the indoor units 200*b* and 200*c* where the heating operation is required, and the remaining refrigerant is supplied to the indoor unit 200*a* where the cooling operation is required. The refrigerant that passed through the electromagnetic valves 33 and 35 flows into the indoor units 200*b* and 200*c* where the heating operation is required and dissipate heat in the indoor heat exchangers 9*b* and 9*c* and is depressurized to an intermediate pressure at the electronic expansion valves 8*b* and 8*c*. On the other hand, the indoor unit 200*a* where the cooling operation is required is supplied with one portion of the refrigerant that passed through the electronic expansion valves 8*b* and 8*c*. The remaining refrigerant passes through the electronic expansion valve 21 and flows into the low pressure pipe 64. The refrigerant that passed through the electronic expansion valve 8*a*, after handing the thermal load in the space to be air conditioned in the indoor heat exchanger 9*a*, passes through the electromagnetic valve 30, and joins with refrigerant in the gas/liquid phase flowing out from the electronic expansion valve 21.

The refrigerant passed through the low pressure pipe 64 flows through the check valve 91 and flows into the check valve 91 and flows into the check valve 97 and the electromagnetic valve 27. The refrigerant that passed through the check valve 97 flows into the first outdoor heat exchanger 3*a* and evaporate therein because the electromagnetic valve 26 and the check valve 93 are closed. The refrigerant evaporated in the second indoor heat exchanger 3*b* flows through the check valve 96 and is joined to the refrigerant evaporated in the first outdoor heat exchanger 3*a* and, because the pre-expansion valve 6 and the bypass valve 7 are closed, flows through the electromagnetic valve 29 and from the second port 2*b* to the first port 2*a* of the four-way valve 2 and into the first compressor 1.

Thus, in this embodiment, the power recovery by the expansion machine is not performed In this embodiment, in the full cooling operation where the expansion machine is utilized, the heat transfer area of the outdoor heat exchanger disposed on the suction side of the second compressor 5*b* is controlled in accordance with the environmental conditions to realize a high efficiency operation. For example, when the outdoor temperature is increased as shown in FIG. 8 showing the first embodiment, the heat radiator outlet temperature is increased and the expansion power is increased, so that the operation is achieved in the direction of opening the on-off valve 6 which is the pre-expansion valve or the on-off valve 7 which is the bypass valve (toward the decreased rotational number), and when the outdoor temperature is decreased, the heat radiator outlet temperature is decreased and the expansion power is decreased, so that the operation is achieved in the direction of closing the on-off valve 6 or the on-off valve 7 is closed (toward the increased rotational number).

Accordingly, in this embodiment, when the outdoor temperature is decreased, utilizing the relationship shown in FIG. 8, the heat transfer area of the outdoor heat exchanger on the suction side of the second compressor 5*b* (number of the outdoor heat exchanger) is decreased by the on-off operation of the electromagnetic valve, and the loss of the recovered power at the on-off valve 7 which is the pre-expansion valve can be decreased. On the other hand, when the outdoor temperature is increased, the heat transfer area of the outdoor heat exchanger on the suction side of the second compressor 5*b* (number of the outdoor heat exchanger) is increased, and the loss of the recovered power at the on-off valve 7 which is the pre-expansion valve can be decreased. This control concept is applicable not only when the outdoor temperature is changed, but also when the indoor temperature or the air conditioning load is changed.

From the above, it is understood that, in accordance with the environmental conditions such as the outdoor temperature, indoor temperature and air conditioning load, the heat transfer area (number of outdoor heat exchanger used) of the outdoor heat exchanger on the suction side of the second compressor 5*b* is increased or decreased to minimize the recovered power loss at the expansion machine 5*a*, enabling an efficient operation of the refrigeration cycle device.

It is to be noted that the method for controlling the flowing refrigerant flow rate and the recovered power utilizing the bypass valve 7 and the pre-expansion valve 6 disposed at the inlet portion of the expansion machine 5*a* is similar to that of the first embodiment, so that the detailed explanation thereof is omitted.

From the above, it is understood that, in the refrigeration cycle device where the cooling operation and the heating operation can simultaneously be achieved, by achieving the power recovery operation by the expansion machine only in the full cooling operation mode, and by increasing and decreasing the heat transfer area of the outdoor heat exchanger on the suction side of the second compressor 5*b* in accordance with the environmental conditions such as the outdoor temperature, the indoor temperature and the air conditioning load, the loss in the recovery power can be minimized, enabling an efficient operation of the refrigeration cycle device. While the transfer area is changed at the suction side of the second compressor 5*b* in this embodiment, the arrangement may be such that the heat transfer area at the discharge side of the second compressor 1 is changed to change the inlet density of the expansion machine 5*a*. Also, in stead of increasing or decreasing the heat transfer area, the arrangement may be such that the air flow rate to the outdoor heat exchanger may be increased or decreased.

[Embodiment 3]

The description will now be made as to the refrigeration cycle device according to the third embodiment shown in FIGS. 11-16. The third embodiment differs from the first embodiment that the expansion machine unit has formed therein a second compression discharge pressure space and the outlet side of the bypass circuit is connected to the second compression discharge pressure space. This structure allows the fluid flowing through the bypass circuit to always flows into the refrigeration circuit via the second compression discharge pressure space.

Figure 11:
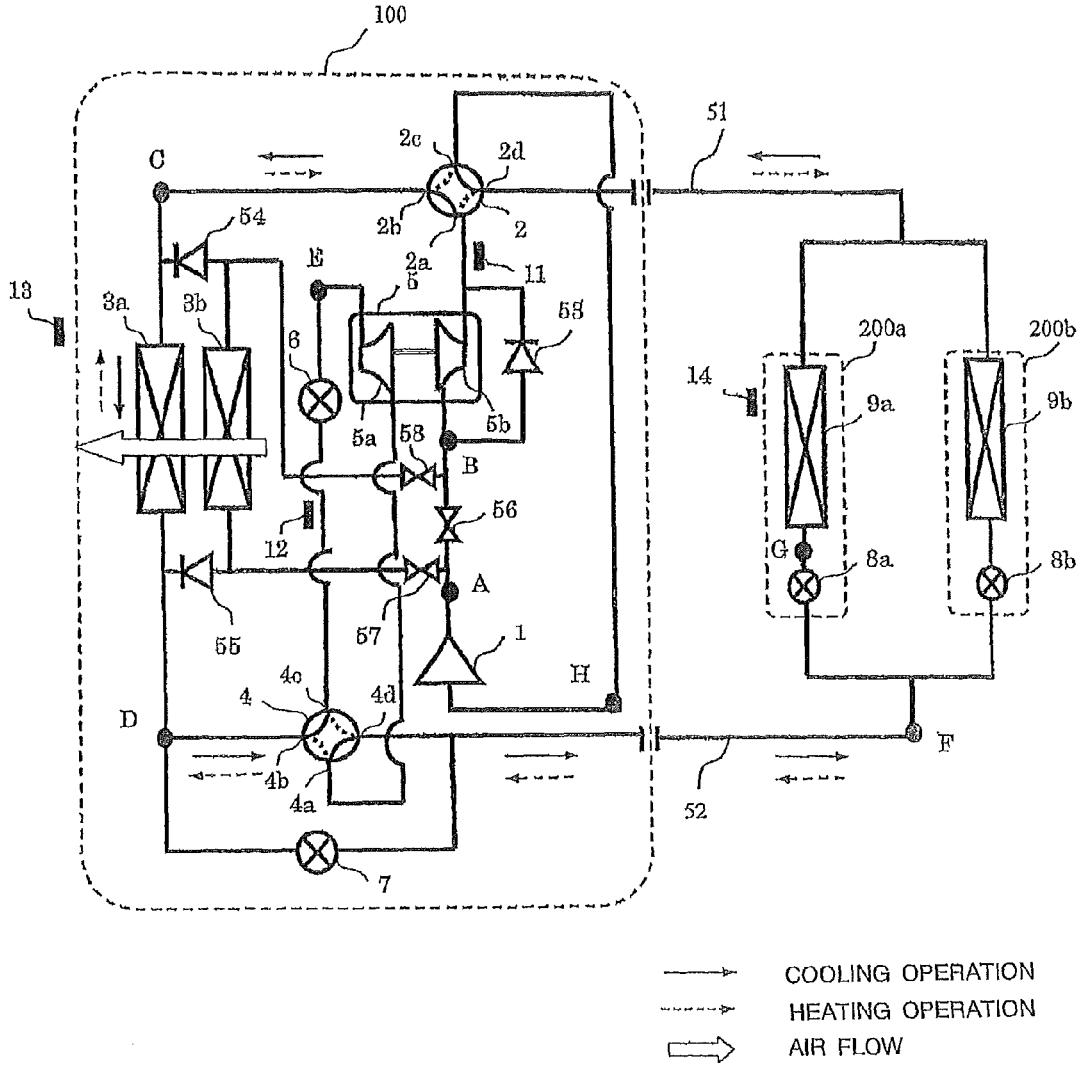
FIG. 11 is a view showing the structure of the refrigeration cycle device of the present invention (Embodiment 3).
Figure 12:
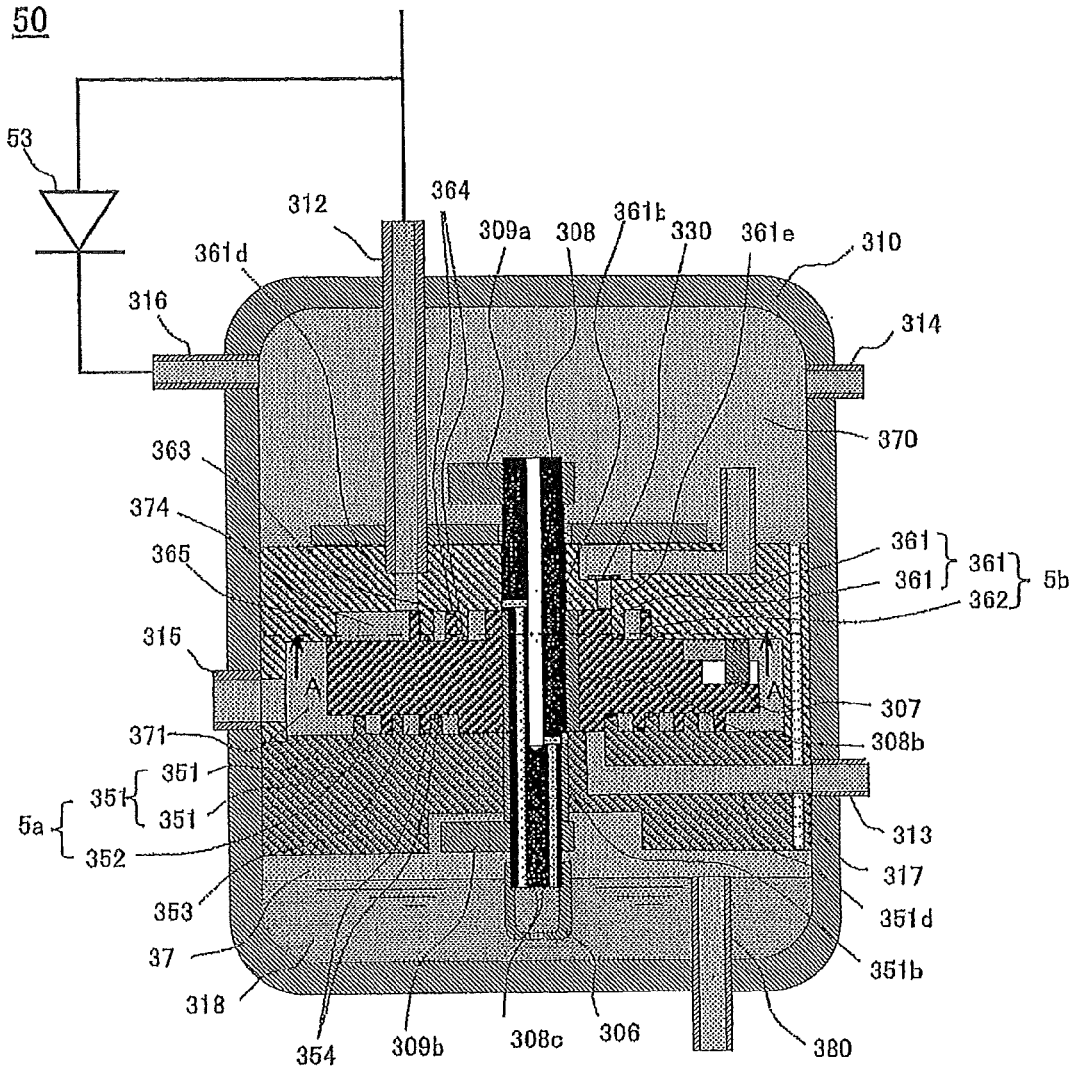
FIG. 12 is a view showing a section of the second compressor integral type expansion machine of the refrigeration cycle device of the present invention (Embodiment 3).

FIG. 11 is a schematic diagram of the refrigeration cycle device according to the third embodiment of the present invention and FIG. 12 is a view showing the detailed structure of the expansion unit according to the third embodiment of this invention. In the figures, the same reference numerals designate the same or identical components, and this applies equally to the entire application.

In the refrigeration cycle device according to this embodiment, the outdoor unit 100 disposed outdoor has contained therein the first compressor 1 for compressing the refrigerant gas, the four-way valve 2 and the four-way valve 4 which are refrigerant flow path change over means for changing the flow of refrigerant according to the operational mode of the indoor units 200*a* and 200*b*, the first outdoor heat exchanger 3*a* and the second outdoor heat exchanger 3*b* which serves as a heat radiator or an evaporator according to the operational mode, and an unillustrated blower for forcedly supplying outdoor air to the outer surfaces of the first outdoor heat exchanger 3*a* and the second outdoor heat exchanger 3*b*.

The expansion machine unit 50 is provided therein with the expansion machine 5*a* and the second compressor 5*b* and they are coaxially connected. The second compressor 5*b* is provided with a bypass circuit formed by external piping and a bypass valve 53 which is a check valve as the on-off valve in the bypass circuit, the outlet end of the bypass circuit being connected to the expansion machine unit 50. Other components constituting the refrigeration cycle and the control method therefore are similar to those of the first embodiment, so that the detailed description is omitted.

FIG. 12 shows the structure of the expansion machine unit 50 of the refrigeration cycle device shown in FIG. 11, both the expansion machine 5*a* and the second compressor 5*b* being in the scroll type structure. The hermetic vessel 310 of the expansion machine unit 50 has installed at the lower portion of thereof the expansion machine 5*a*, and above the expansion machine 5*a* the second compressor 5*b*. The expansion machine 5*a* is composed of an expansion machine stationary scroll 351 and an expansion machine orbiting scroll 352, and the second compressor 5*b* is composed of the second compressor stationary scroll 361 and the second compressor orbiting scroll 362. At the center of these scrolls, a shaft 308 is penetrated, the shaft 308 has disposed at its both end portions balance weights 309*a* and 309*b*, and the shaft 308 is supported by an expansion mechanism side bearing portion 351*b* and a second compression mechanism side bearing portion 361*b*. The expansion mechanism side scroll 352 and the second compression mechanism side scroll 362 are of the back-to-back structure or the integral structure wherein they have a common base plate. The orbiting scroll has disposed at its central portion a crank portion 308*b* for eccentrically drive the orbiting scroll, and on the second compression mechanism side an Oldham ring 307 for restricting the rotation of the orbiting scroll.

At the bottom end of the shaft 308, an oil supply pump 306 is mounted, and an oil supply bore 308*c* is formed in the shaft 8. On the outer circumference portions of the stationary scroll 351 and the stationary scroll 361, an oil return bore 317 is formed to extend from the upper space 370 of the stationary scroll 361 and not communicated with the orbiting scroll moving space 371, and a lubricating oil 318 is stored in the lower space 372 of the stationary scroll 351.

In the bottom portion of the hermetic vessel 310 in which the lubricating oil 318 is stored, an oil pipe 380 for communicating the first compressor 1 with a position higher than the optimum oil level or the bottom surface of the hermetic vessel 310.

At the outer circumference of the expansion mechanism 5 and at the side surface of the hermetic vessel 310, an expansion suction pipe 313 for suctioning the refrigerant and an expansion discharge pipe 315 for discharging the expanded refrigerant. On the other hand, above the second compressor 5*b* and at the upper surface of the hermetic vessel 310, a second compression suction pipe 312 for suctioning the refrigerant is disposed. Above the stationary scroll 361 of the second compressor 5*b* and at the side surface within the hermetic vessel 31, a bypass pipe 316 connected to the bypass valve 53 and a second compression discharge pipe 314 for discharging the compressed refrigerant are disposed.

In the expansion machine 5*a*, the base plate 351*a* of the stationary scroll 351 has formed therein an expansion suction port 351*d* for suctioning the refrigerant and it is connected to the expansion suction pipe 313. At the tip ends of the scrolls 351*s* of the stationary scroll 351 and the expansion mechanism side scroll 352 of the orbiting scroll, tip seals 354 are attached for sealing the second compression chamber 353 defined by the scroll 351*s* of the stationary scroll 351 and the expansion mechanism side scroll 352 of the orbiting scroll.

In the second compressor 5*b*, the base plate 361*a* of the stationary scroll 361 has formed therein a second compression suction port 361*d* for suctioning the refrigerant and a second compression discharge port 361*e* for discharging the refrigerant, the second compression suction port 361*d* being connected to the second compression suction pipe 312. At the tip ends of the scrolls 361*s* of the stationary scroll 361 and the second compression mechanism side scroll 362 of the orbiting scroll, tip seals 364 are attached for sealing the second compression chamber 363 defined by the scroll 361*s* of the stationary scroll 361 and the second compression mechanism side scroll 362 of the orbiting scroll. Also, at the outer circumference and in the surface opposing to the orbiting scroll, an outer circumference seal 365 for sealing between the orbiting scroll and the stationary scroll 361 is provided.

Figure 13:
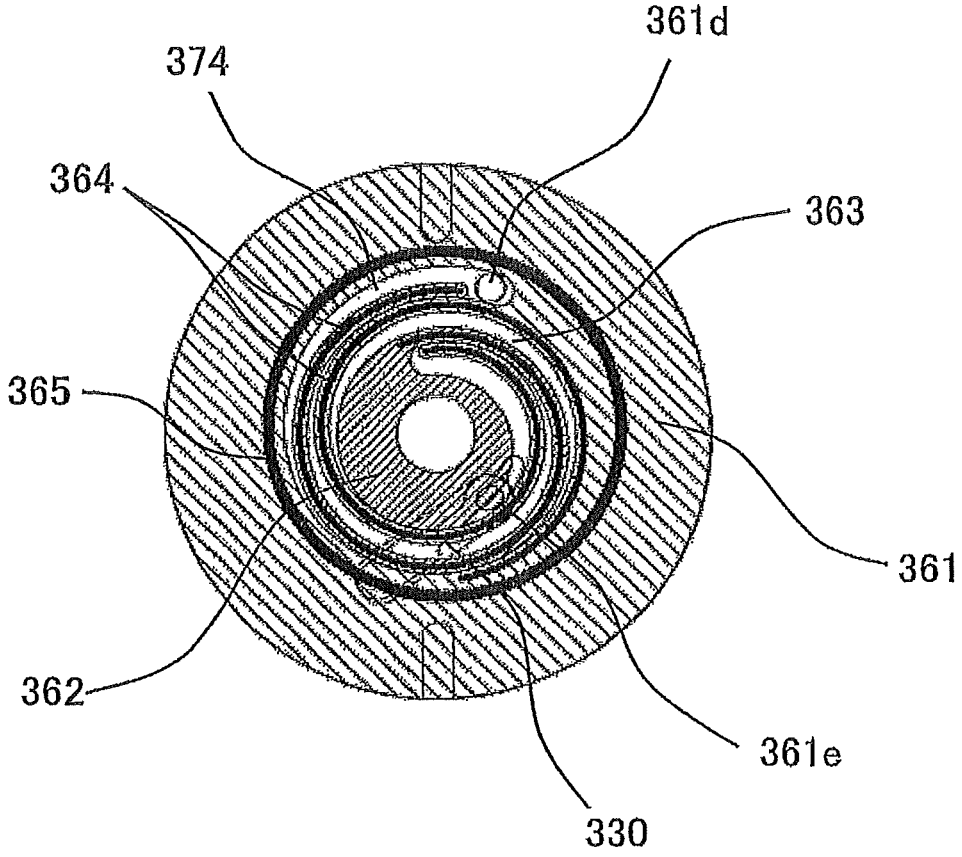
FIG. 13 is a plan view showing the second compression mechanism of the second compressor integral type expansion machine of the refrigeration cycle device of the present invention (Embodiment 3).

FIG. 13 is a plan view showing the second compressor 5*b* according the third embodiment of the present invention, which shows a combination of the second compression mechanism side scroll 362 of the orbiting scroll and the stationary scroll 361. The second compression suction port 361*d* is disposed in a position not interfering with the outer end portion of the second compression mechanism side scroll of the orbiting scroll, and a space defined between the outermost circumferential wall of the second compression chamber 363 and the outer seal 365 disposed on the stationary scroll 361 is the suction pressure space 374 for the second compressor 5*b*.

Figure 14:
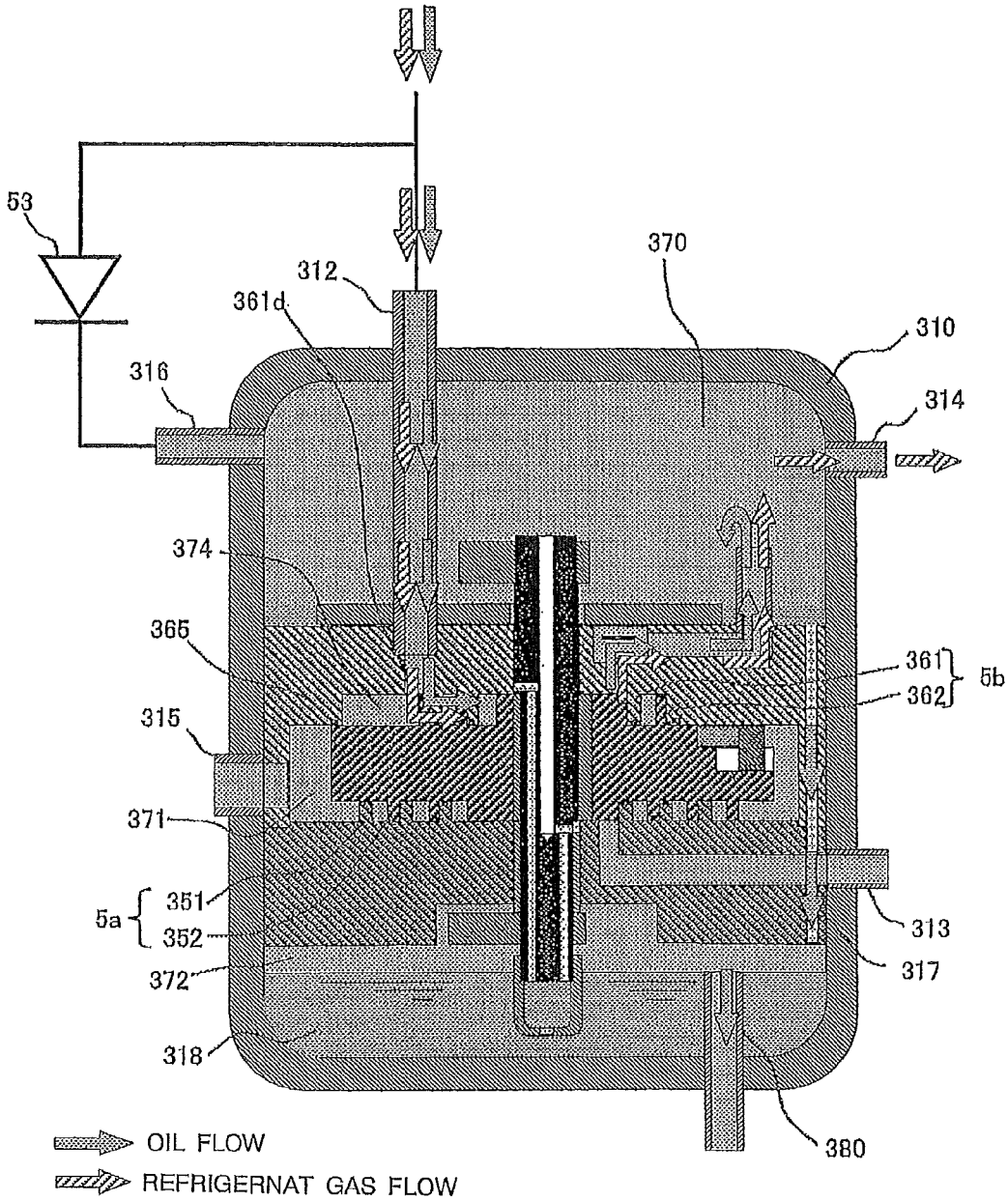
FIG. 14 is a sectional view showing the flows of the refrigerant and the oil of the second compressor when there is no bypass of the refrigeration cycle device of the present invention (Embodiment 3).

Then, the operation of the expansion machine unit 50 will be described. FIG. 14 is a view illustrating the flows of the refrigerant gas and the oil in the second compressor of the third embodiment of the present invention.

The power is generated by the expansion of the high pressure refrigerant suctioned from the expansion suction pipe 313 within the expansion chamber 353 defined by the stationary scroll 351 and the expansion mechanism side scroll 352 of the orbiting scroll. The refrigerant expanded and depressurized within the expansion chamber 353 is discharged via the orbiting scroll movement space 371 from the expansion discharge pipe 315 to outside of the hermetic vessel 310.

The refrigerant suctioned from the second compression suction pipe 312 is compressed and pressurized within the second compression chamber 363 defined by the stationary scroll 361 of the second compressor 5*b* and the second compression mechanism side scroll 362 of the orbiting scroll by the power generated at the expansion machine 5*a*. The refrigerant compressed and pressurized within the second compression chamber 363 is, after discharged into the upper space 370 within the hermetic vessel 310, discharged to the outside of the hermetic vessel 310 through the second compression discharge pipe 314. At this time, the outer circumference portion of the second compressor 5*b* and the orbiting scroll movement space 371 is sealed by the outer circumference seal 365, so that the orbiting scroll moving space 371 is at an expanded pressure, and the lower space 372 is at the compressed pressure of the second compressor equal to that of the upper space 370 via the oil return bore 317 that is not communicated with the orbiting scroll moving space 371. The bypass valve 53 disposed exterior of the hermetic vessel 310 is closed due to the pressure difference in the second compressor 5*b*.

Then the behavior of the oil circulating together with the refrigerant gas in the second compressor will now be described. The oil suctioned into the second compressor 5*b* together with the refrigerant gas from the first compressor 1 flows from the second compression discharge port 361*e* into the upper space 370 through the discharge valve 330. The oil flowed into the upper space 370 is gas-liquid separated in the upper space 370 and collected at the upper surface of the stationary scroll 361 and then returned to the oil reservoir portion of the lower space 372 via the oil return bore 317. The excessive oil stored in the lower space 372 is returned to the first compressor 1 due to the pressure difference between the first compressor 1 and the lower space 372 via the oil pipe 380 disposed in the bottom portion of the hermetic vessel 310 to maintain the oil level at a proper level. Thus the above is the operation when the pressure difference is generated within the second compressor 5*b*.

Figure 15:
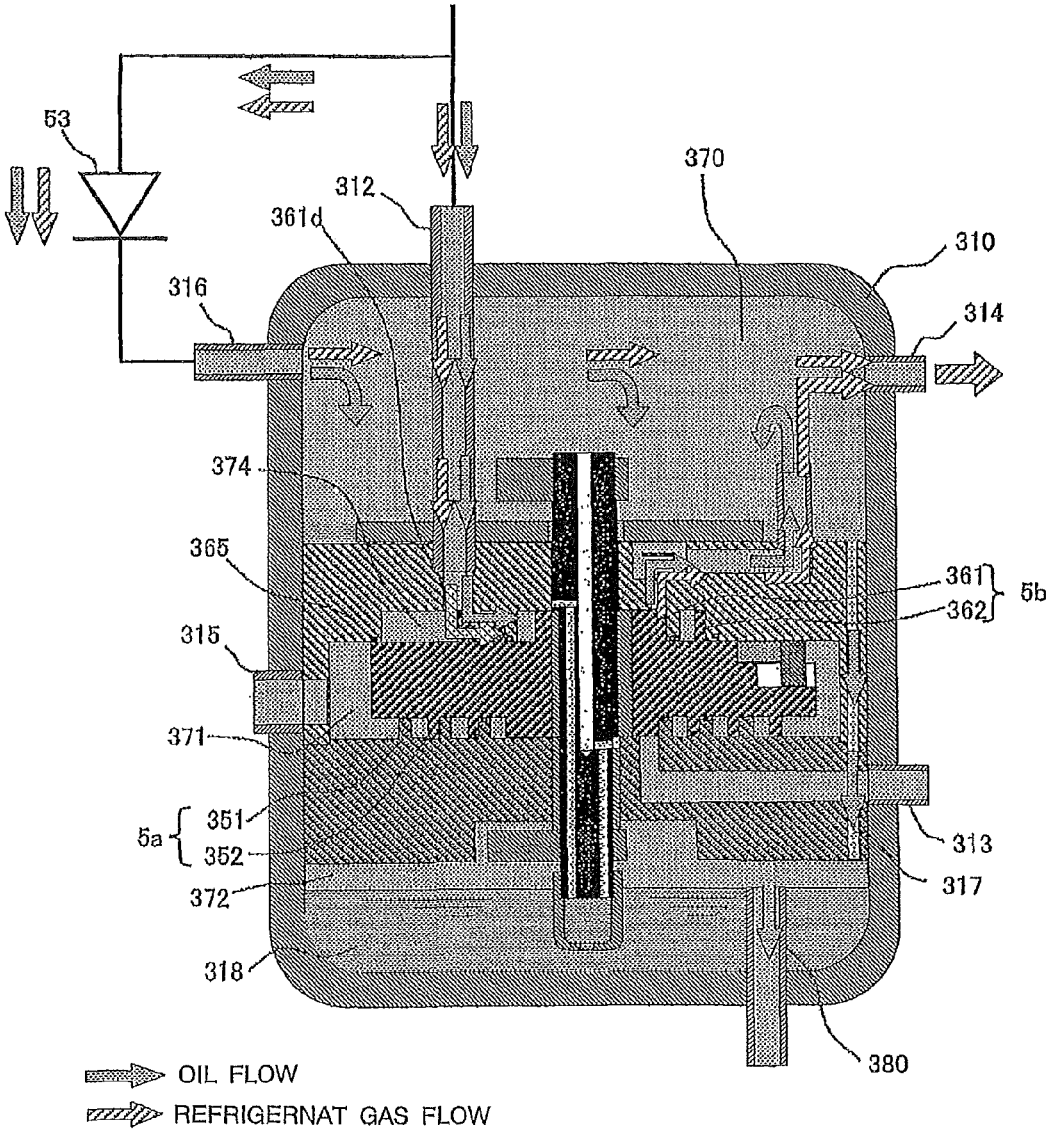
FIG. 15 is one example of a sectional view showing the flows of the refrigerant and the oil of the second compressor when there is a bypass of the refrigeration cycle device of the present invention (Embodiment 3).

Then the description will be made in terms of the operation when there is no pressure difference in the second compressor 5*b* (such as during the heating operation of the refrigeration system using the expansion machine only during the starting up or cooling operation or during the low rotation number operation). FIG. 15 is a view showing one example of flows of the refrigerant gas and the oil in the second compressor according to the third embodiment of the present invention when no pressure difference is generated in the second compressor 5*b*. At this time, the rotational number is small, the suction flow rate is of the second compressor 5*b* is less than the discharge flow rate of the first compressor 5*a*, the suction pressure of the second compressor 5*b* is higher than the compressed pressure, and the bypass valve 53 is in the open state. The refrigerant gas discharged from the first compressor 1 is divided and flows into a flow path in which it is suctioned by the second compression suction pipe 312 and discharged into the upper space 370 through the second compression chamber 363 and a flow path in which it flows through the bypass pipe 53 and the bypass pipe 316 into the upper space 370. Thereafter, it flows through the second compression discharge pipe 314 and is discharged to the outside of the hermetic vessel 310. The oil circulating together with the refrigerant gas is also divided similarly to the refrigerant gas into two flow paths and flows into the upper space 370. The oil flowed together with the refrigerant gas is separated into gas and liquid within the upper space 370, stored on the upper surface of the stationary scroll 361, and returned to the oil storing portion in the lower space 372 via the oil return hole 317.

Figure 16:
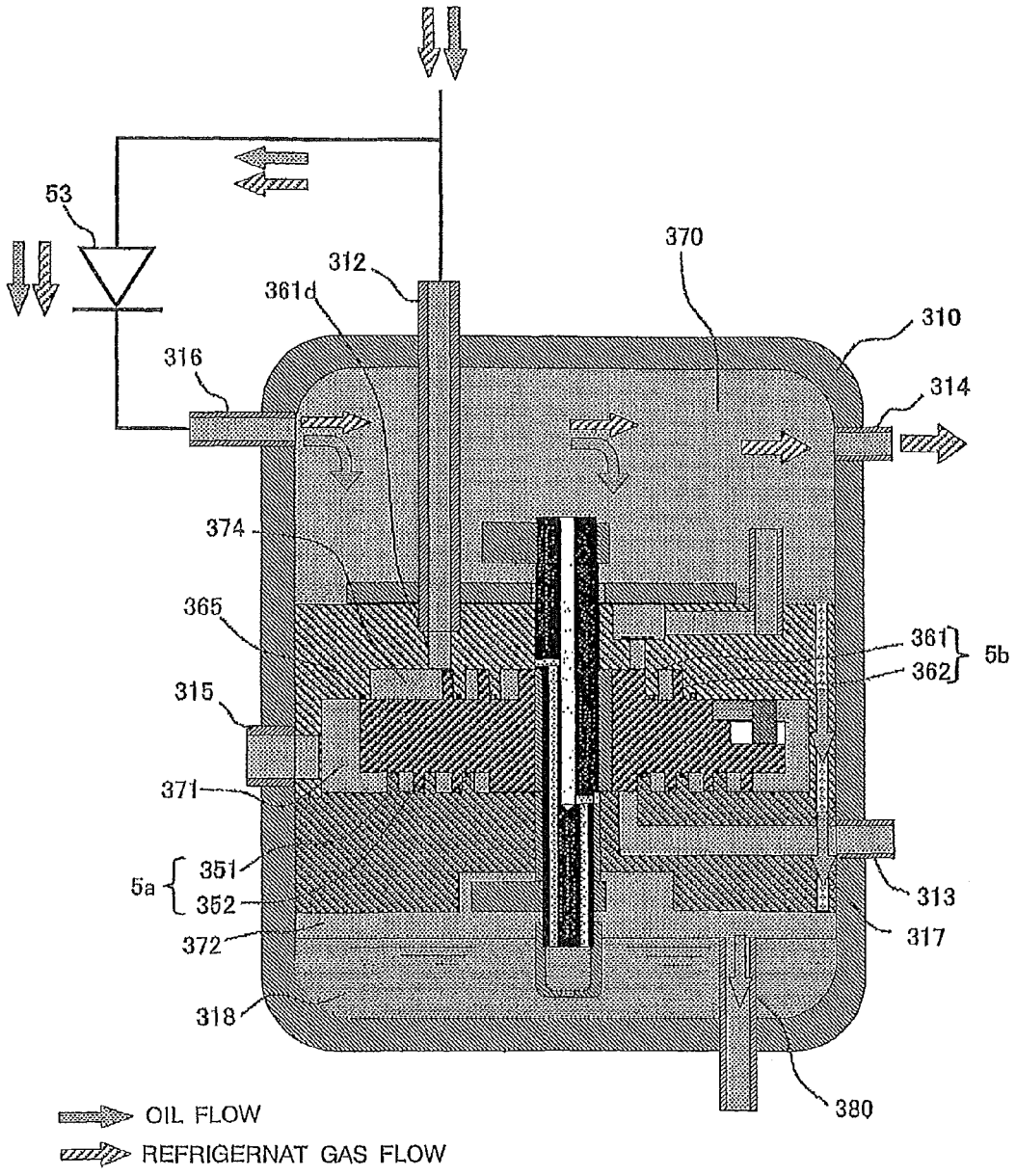
FIG. 16 is another example of a sectional view showing the flows of the refrigerant and the oil of the second compressor when there is a bypass of the refrigeration cycle device of the present invention (Embodiment 3).

FIG. 16 is a view showing another example of flows of the refrigerant gas and the oil of the second compressor according to the third embodiment of the present invention when there is no pressure difference in the second compressor 5*b*. At this time, the second compressor 4*b* is not rotated and entire the refrigerant gas and the circulating oil flowing in the refrigeration cycle device flows in the bypass pipe 314 and flows into the upper space 370. Thereafter, the refrigeration gas is discharged out of the hermetic vessel 310 via the second compression discharge pipe 314. On the other hand, the oil entrained in the refrigerant gas is separated from the oil within the upper space 370, stayed on the upper surface of the stationary scroll 361, and returned to the oil reservoir portion in the lower space 372 via the oil return hole 317.

That is, in this embodiment, the excessive amount of the flow is automatically bypassed by the bypass valve 53 and whole amount of refrigerant gas and the circulating oil flowing through the refrigeration cycle device is always passed through the upper space 370 of the second compressor 5*b* and is separated into gas and liquid in the upper space 370.

The oil supply mechanism in the expansion unit 50 will now be described. When the shaft 308 is rotated by the expansion power of the expansion machine 5*a* the oil supply pump 306 supplies the lubricating oil 318 stored within the lower space 372 to the bearing portions 361*b* and 352*b* and the crank portion 308*b* via the oil supply bore 308*c*. Also, the oil leaked into the upper space 370 from the lubricating oil 318 supplied to the bearings 361*b* and 352*b* as well as the crank portion is returned to the oil reservoir portion in the lower space 372 via the oil return hole.

As for the thrust load acting on the orbiting scroll, the orbiting scroll movement space in this embodiment is also at the expanded pressure and is similar to the first embodiment.

According to the above structure, the oil separated within the expansion machine unit 50 is moved between the first compressor 1 and the expansion machine unit 50 second directly to the first compressor 1 without passing through the refrigerant cycle circuit, so that the expansion machine unit 50 functions as an oil separator for the first compressor 1, providing an advantageous effect that the degrading of the heat exchanging performance due to mixture of the oil into the refrigerant can be suppressed.

Also, because of the oil separating function of the expansion machine unit 50 and the oil level regulating function of the oil pipe 380, an optimum oil level can be always maintained in the lower space 372, a stable oil supply to the bearing portion can be established and the generation of the agitation loss due to an excessive amount of oil can be prevented, so that the starting up performance can be improved.

[Embodiment 4]

Figure 18:
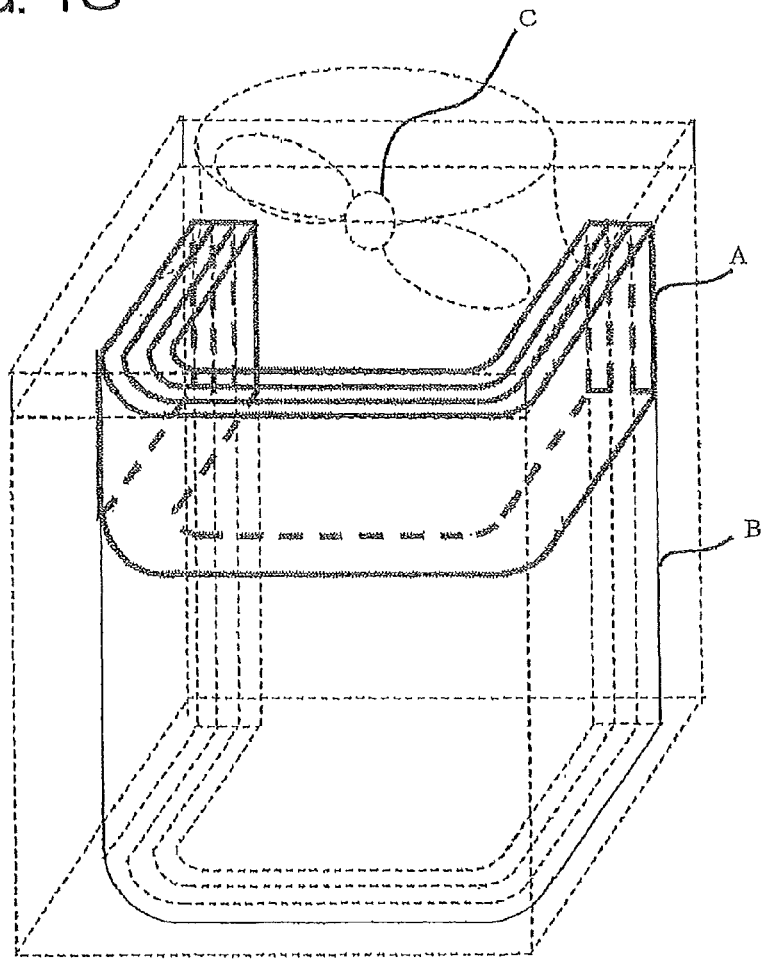
FIG. 18 is a view showing the structure of the outdoor heat exchanger when the second outdoor heat exchanger is disposed on the upper stage in the refrigeration cycle device of the present invention (Embodiment 4).
Figure 19:
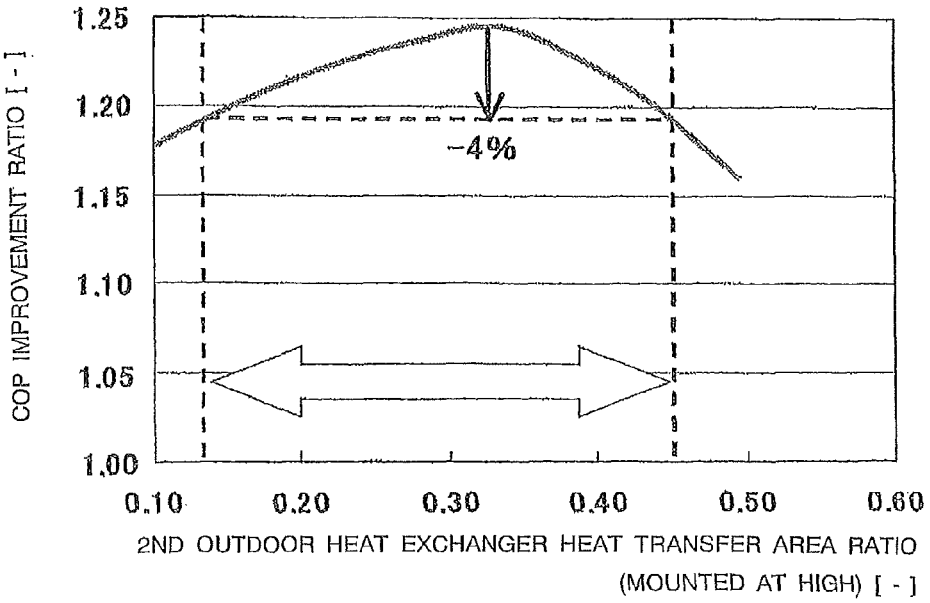
FIG. 19 is a view showing the relationship between the heat transfer area ratio and the COP improvement ratio when the second outdoor heat exchanger is disposed on the upper stage in the refrigeration cycle device of the present invention (Embodiment 4).

The refrigeration cycle device according to the fourth embodiment of the present invention shown in FIGS. 17-19 will be described. As has been described in conjunction with the refrigeration cycle device shown in FIGS. 1-9, the COP improvement ratio can be made maximum by setting the heat transfer area of the second outdoor heat exchanger 3*b* to be 0.3-0.5 and the expansion compression volume ratio to be 1.8-2.3 when the air speed distribution in the column direction of the heat exchanger is uniform. However, when the fan is mounted higher than the heat exchanger, an air speed difference is generated in the column direction of the heat exchanger, and the heat transfer performance changes at each of the first outdoor heat exchanger 3*a* and the second outdoor heat exchanger 3*b*, making the ratio of the heat transfer area different from that provides the same performance as that when the air speed distribution is uniform. Therefore, in actually manufacturing the heat exchanger, the air speed distribution in the column direction of the heat exchanger must be taken into consideration.

Figure 17:
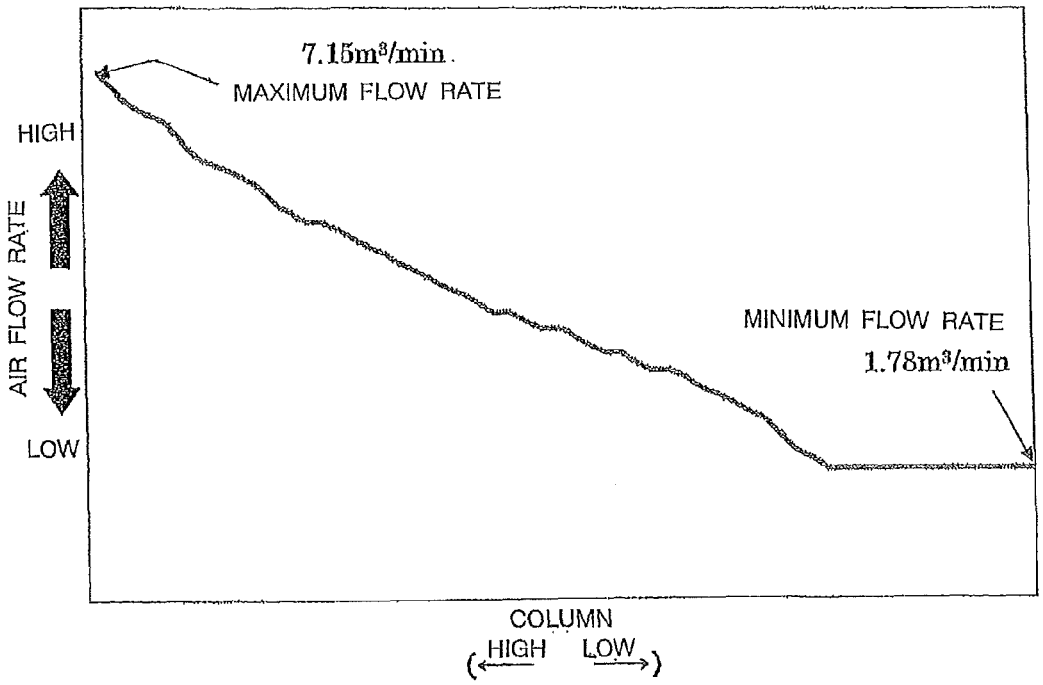
FIG. 17 is a view showing the air speed distribution in the column direction of the outdoor heat exchanger of the refrigeration cycle device of the present invention (Embodiment 4).

It is now assumed that the air speed distribution in the column direction of the heat exchanger is as shown in FIG. 17. This is the case where, as shown in FIG. 18, the fan in the C section is disposed in a position upper than the heat exchanger, the A section positioned high in the heat exchanger is used as the second outdoor heat exchanger, the B section positioned low is used as the first outdoor heat exchanger, and with the air speed distribution in the column direction of the heat exchanger taken into consideration, the COP improvement ratio exhibits the local maximal at a heat transfer area ratio of the A section of around 0.33 as shown in FIG. 19. When it is assumed that the expansion machine mounted circuit can be effectively utilized even at −4% of the local maximal of the COP improvement ratio, the heat transfer area ratio in the A section is preferably within a range of 0.13-0.45. As understood from FIG. 17, when the fan is installed higher than the heat exchanger, the heat transfer area ratio becomes smaller than that where the air speed distribution is uniform since the air speed in the heat exchanger is higher in the higher position. Further, as shown in FIG. 18, by arranging the heat exchanger integral or by dividing so that the fins are not common in the row direction, the installation space of the heat exchanger can be made small, and by installing the A section at the high position in the heat exchanger, the heat transfer area of the A section can be made small, enabling the cost reduction of the heat exchanger as compared to the case where the first outdoor heat exchanger and the second outdoor heat exchange are independently used.

[Embodiment 5]

Figure 20:
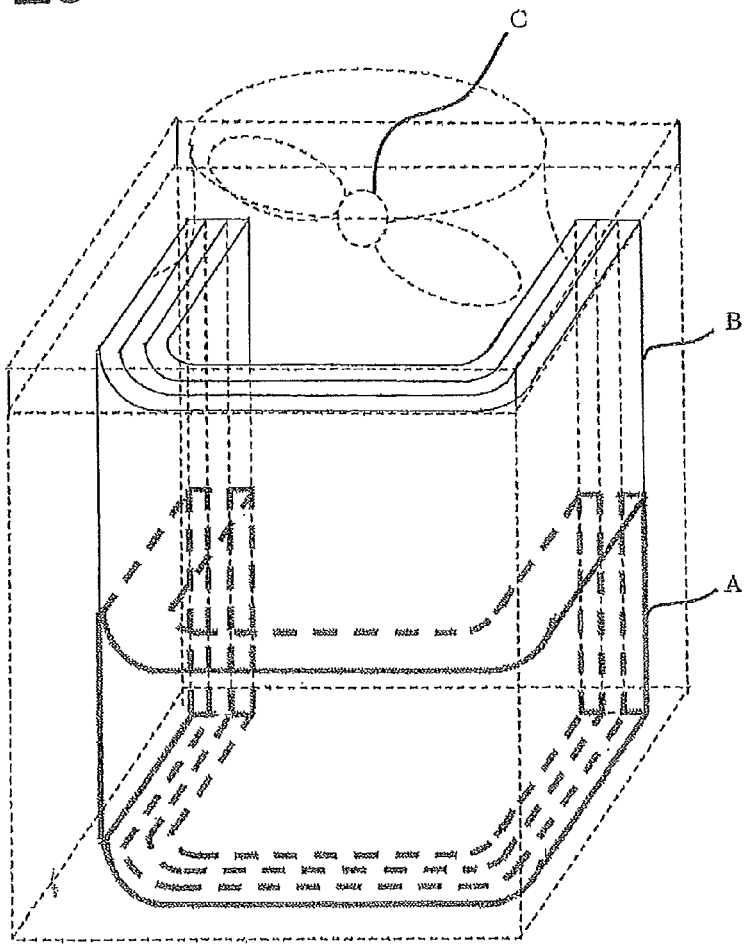
FIG. 20 is a view showing the structure of the outdoor heat exchanger when the second outdoor heat exchanger is disposed on the lower stage of the refrigeration cycle device of the present invention (Embodiment 5).
Figure 21:
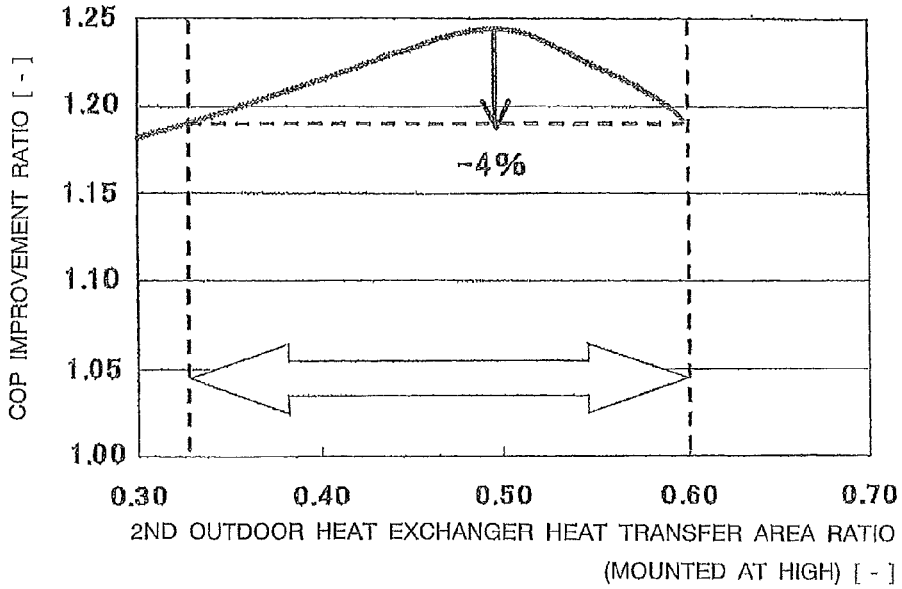
FIG. 21 is a view showing the relationship between the heat transfer area ratio and the COP improvement ratio when the second outdoor heat exchanger is disposed on the lower stage in the refrigeration cycle device of the present invention (Embodiment 5).

When the fan in the C section is mounted higher than the heat exchanger and the second outdoor heat exchanger A section is disposed at a position lower than the first outdoor heat exchanger B section as shown in FIG. 20, the relationship of the COP improvement ratio relative to the heat transfer area ratio is as shown in FIG. 21, wherein the COP improvement ratio is at its local maximal when the heat transfer area ratio of the A section is about 0.50. Assuming that the expansion machine installation circuit can be effectively utilized at the COP improvement ratio of −4% of the local maximal of the COP improvement ratio, the heat transfer area ratio of the A section should preferably be within the range of 0.32-0.60. By utilizing the A section disposed at a low positioned in the heat exchanger as the second outdoor heat exchanger, the pass number in the A section can be increased and the pressure loss in the A section can be decreased. Further, by arranging the heat exchanger in an integral structure or in a divided structure in which fins are not common in the row direction as shown in FIG. 20, the installation space for the heat exchanger can be made small as compared to the case where the second outdoor heat exchanger and the first outdoor heat exchanger are independently used, enabling to reduce the cost of the heat exchanger.

[Embodiment 6]

Figure 22:
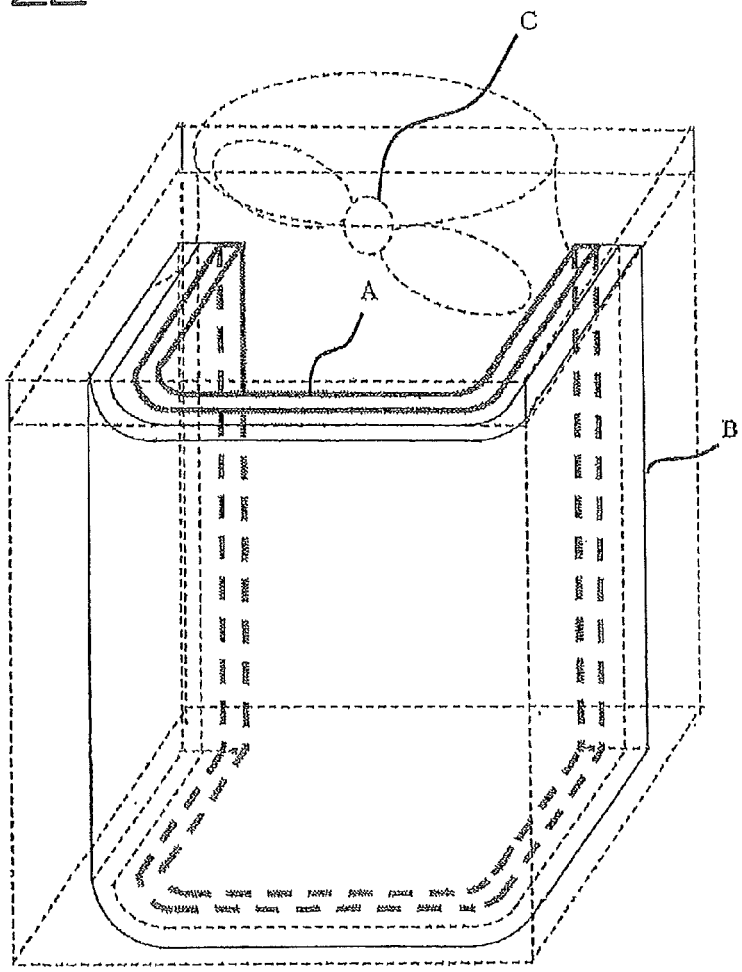
FIG. 22 is a view showing the structure of the outdoor heat exchanger when the second outdoor heat exchanger is disposed in a row in the refrigeration cycle device of the present invention (Embodiment 6).

Further, as shown in FIG. 22, when the fan of the C section is mounted higher than the heat exchanger, the arrangement may be such that the outdoor heat exchanger is divided in the row direction and the second outdoor heat exchanger in the A section is downstream of the first outdoor heat exchanger in the B section. By positioning the second outdoor heat exchanger in the A section on the downstream side, an opposing flow is established in which the heat exchanging is achieved between the high temperature refrigerant and air in the second outdoor heat exchanger in the A section, and between the low temperature refrigerant and air in the first outdoor heat exchanger in the B section.

Also, in this embodiment, the ratio of the heat transfer area of the second outdoor heat exchanger relative to the total heat transfer area of the outdoor heat exchanger is determined only by the performance during the cooling operation. It is to be noted that, when the outdoor heat exchanger is utilized as the evaporator during the heating operation, the enthalpy difference between the suctioned air and the refrigerant temperature corresponding saturation moisture air (the enthalpy difference is the driving temperature difference in heat exchanging because the heat exchanger is in the moist state in the evaporator) is small, making the effect of the heat transfer area ratio on the performance small, so that the above heat transfer are ratio can be determined only by the performance during the cooling operation.

Also, in this embodiment, the arrangement is such that the first and the second outdoor heat exchangers are used even during the heating operation. Through the use of the first and the second outdoor heat exchangers shunted by the pipes, the pressure loss generated when the refrigerant flows into the respective heat exchangers can be decreased, and the refrigerant amount flowing into the heat exchangers can be regulated by the length and the diameter of the shunt pipes.

From the above, when the fan is mounted higher than the heat exchanger and the air flow distribution in the column direction of the heat exchanger is to be taken into consideration, the second outdoor heat exchanger is disposed at a position higher than the first heat exchanger, and the heat transfer area ratio of the heat transfer area of the second outdoor heat exchanger relative to the total heat transfer area of the heat transfer areas of the first and the second outdoor heat exchangers is set at 0.13-0.45, and when the second outdoor heat exchanger is disposed at a position lower than the first outdoor heat exchanger, and the heat transfer area ratio of the heat transfer area of the second outdoor heat exchanger relative to the total heat transfer area of the heat transfer areas of the first and the second outdoor heat exchangers is set at 0.32-0.60, and when the outdoor heat exchanger is to be divided in the row direction, the second outdoor heat exchanger is positioned on the downstream side.

[Embodiment 7]

Figure 23:
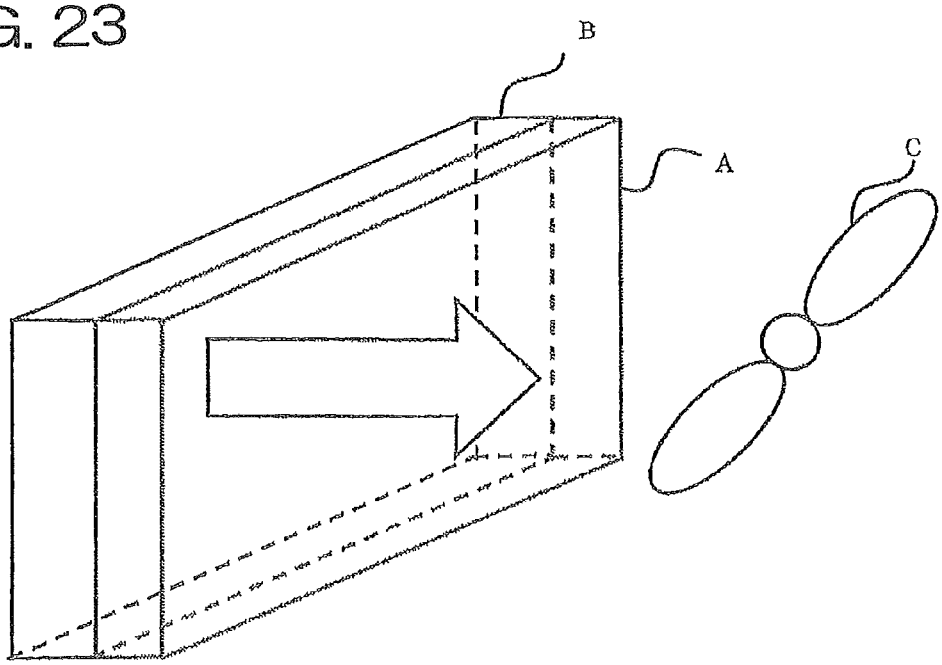
FIG. 23 is a view showing the structure of the outdoor heat exchanger when the second outdoor heat exchanger is disposed in a straight line in the refrigeration cycle device of the present invention (Embodiment 7).

The cross-sectional shape of the heat exchanger may not be U-shape as shown in figures and other shape such as the straight line-shape as shown in FIG. 23. Also, the fan of the C section may not be in the higher portion but may be on the side of the heat exchanger. In the figure, the white arrow indicates the air flow and the A section in the downstream is used as the second outdoor heat exchanger and the B section is used as the first outdoor heat exchanger.

In the embodiments heretofore explained, the expansion machine 5*a* and the second compressor 5*b* is not limited to the scroll type, but may be any type such as the rotary type, the screw type, the reciprocating type, the swing type, the turbo type and the like, and still similar advantageous results can be obtained.

Also, the refrigerant in the refrigeration circuit has been explained as being carbon dioxide, another refrigerant may be used. As for the refrigerant that becomes the supercritical state, a mixture of carbon dioxide and ether such as dimethyl ether, hydrofluoroether, etc. may be used. Also, without being limited to the refrigerant that becomes supercritical state, a refrigerant that achieves heat exchange in the ordinary two-phase state such as a refrigerant including no chlorine such as HFC410A, HFC407C and the like and the conventional Freon family refrigerant such as R22, R134a and the like, or a natural refrigerant such as hydrocarbon may be utilized.

The invention claimed is:

1. A refrigeration cycle device comprising a first compressor, a second compressor driven by recovered power recovered by an expansion machine, refrigerant flow path changeover means, a load side heat exchanger, a first heat source side heat exchanger and a second heat source side heat exchanger, and changeable between a cooling operation and a heating operation by said refrigerant flow path change-over means;

wherein said second compressor and said first compressor are connected in series; said second heat source side heat exchanger is disposed between said first compressor and said second compressor during the cooling operation, and wherein the operation is performed by the utilization of said first heat source side heat exchanger and said second heat source side heat exchanger irrespective of operation mode, wherein an inlet portion of the first heat source side heat exchanger and an inlet portion of the second heat source side heat exchanger are connected therebetween by a first pipe having only a first check valve during the heating operation and an outlet portion of the first heat source side heat exchanger and an outlet portion of the second heat source side heat exchanger are connected therebetween by a second pipe having only a second check valve during the heating operation, wherein the first and the second check valves and the refrigerant flow path changeover means are arranged so that the first heat source side heat exchanger and the second heat source side heat exchanger are connected in series during the cooling operation and the first heat source side heat exchanger and the second heat source side heat exchanger are connected in parallel during the heating operation, and during the cooling operation, the outlet of the first compressor is connected to the inlet of the second heat source side heat exchanger, the outlet of the second heat source side heat exchanger is connected to the inlet of the second compressor, and the outlet of the second compressor is connected to the inlet of the first heat source side heat exchanger, and wherein an efficiency of heat exchange of the first heat source side heat exchanger or the second heat source side heat exchanger is controlled in response to at least one of an outdoor air temperature, an air conditioner load and an indoor air temperature.

2. A refrigeration cycle device comprising a first compressor, a second compressor driven by recovered power recovered by an expansion machine, refrigerant flow path changeover means, a load side heat exchanger, a first heat source side heat exchanger and a second heat source side heat exchanger, and changeable between a cooling operation and a heating operation by said refrigerant flow path changeover means;

wherein said second compressor and said first compressor are connected in series; said second heat source side heat exchanger is disposed between said first compressor and said second compressor during the cooling operation, and wherein heat transfer area ratio, which is a ratio of the heat transfer area of the second heat source side heat exchanger relative to the total heat transfer area of the heat transfer areas of said first and second heat source side heat exchangers provided on the high pressure side, is made 0.2-0.6, wherein an inlet portion of the first heat source side heat exchanger and an inlet portion of the second heat source side heat exchanger are connected therebetween by a first pipe having only a first check valve during the heating operation and an outlet portion of the first heat source side heat exchanger and an outlet portion of the second heat source side heat exchanger are connected therebetween by a second pipe having only a second check valve during the heating operation, wherein the first and the second check valves and the refriqerant flow path changeover means are arranged so that the first heat source side heat exchanger and the second heat source side heat exchanger are connected in series during the cooling operation and the first heat source side heat exchanger and the second heat source side heat exchanger are connected in parallel during the heating operation, and during the cooling operation, the outlet of the first compressor is connected to the inlet of the second heat source side heat exchanger, the outlet of the second heat source side heat exchanqer is connected to the inlet of the second compressor, and the outlet of the second compressor is connected to the inlet of the first heat source side heat exchanger, and wherein an efficiency of heat exchange of the first heat source side heat exchanger or the second heat source side heat exchanger is controlled in response to at least one of an outdoor air temperature, an air conditioner load and an indoor air temperature.

3. A refrigeration cycle device, wherein an indoor unit self-containing a first compressor, a second compressor driven by recovered power recovered by an expansion machine, and a plurality of indoor units self-containing a load side heat exchanger and an on-off valve are connected by a pipe, and said plurality of indoor units are independently changeable between a cooling operation and a heating operation;

wherein said second compressor and said first compressor are connected in series; said second heat source side heat exchanger is disposed between said first compressor and said second compressor during the cooling operation, and wherein the operation is performed by the utilization of said first heat source side heat exchanger and said second heat source side heat exchanger irrespective of the operation modes of said indoor units, wherein an on-off valve disposed at the inlet portion of said expansion machine and having an adjustable degree of opening as well as an on-off valve bypassing said expansion machine and having an adjustable degree of opening are provided, and wherein both said on-off valves are controlled to control the temperature or the pressure from the outlet of said second compressor to the inlet of said expansion machine, wherein an inlet portion of the first heat source side heat exchanger and an inlet portion of the second heat source side heat exchanger are connected therebetween by a first pipe having only a first check valve during the heating operation and an outlet portion of the first heat source side heat exchanger and an outlet portion of the second heat source side heat exchanger are connected therebetween by a second pipe having only a second check valve during the heating operation, wherein the first and the second check valves and the refrigerant flow path changeover means are arranged so that the first heat source side heat exchanger and the second heat source side heat exchanger are connected in series during the cooling operation and the first heat source side heat exchanger and the second heat source side heat exchanger are connected in parallel during the heating operation, and during the cooling operation, the outlet of the first compressor is connected to the inlet of the second heat source side heat exchanger, the outlet of the second heat source side heat exchanger is connected to the inlet of the second compressor, and the outlet of the second compressor is connected to the inlet of the first heat source side heat exchanger, and wherein an efficiency of heat exchange of the first heat source side heat exchanger or the second heat source side heat exchanger is controlled in response to at least one of an outdoor air temperature, an air conditioner load and an indoor air temperature.

4. A refrigeration cycle device as claimed in claim 3, wherein said refrigeration circuit has four operation modes of full cooling operation, cooling dominant operation, full heating operation and heating dominant operation, and power recovery by an expansion machine is performed only during the full cooling operation.

5. A refrigeration cycle device as claimed in claim 3, wherein a bypass flow path for bypassing said second compressor is provided and an on-off valve is provided in the bypass flow path.

6. A refrigeration cycle device as claimed in claim 3, wherein said second compressor comprises a vessel for containing a second compression mechanism, a second compression suction pipe disposed in said vessel, a second compression discharge port communicated to a second compression chamber via a second compression discharge valve and opening to a second compression discharge pressure space within said vessel, a second compression discharge pipe disposed in said vessel to open to said second compression discharge pressure space, and a bypass pipe connected at one end to the second compression suction pipe at the outside of said vessel and at the other end to said vessel, said bypass pipe having an on-off valve disposed therein.

7. A refrigeration cycle device as claimed in claim 3, wherein said expansion machine and said second compressor are both of an integral structured scroll-type.

8. A refrigeration cycle device as claimed in claim 3, wherein the volume ratio of the displacement volume of said expansion machine and the displacement volume of said second compressor is 1.5-2.5.

9. A refrigeration cycle device as claimed in claim 3, wherein said both on-off valves are controlled with an operated value operated on the basis of the detected value of said temperature or said pressure used as a target value.

10. A refrigeration cycle device as claimed in claim 9, wherein at least one of said first heat source side heat exchanger and said second heat source side heat exchanger is constituted by a plurality of heat exchangers.

11. A refrigeration cycle device as claimed in claim 3, wherein carbon dioxide is used as a refrigerant.

12. A refrigeration cycle device as claimed in claims 3, wherein an efficiency of heat exchange of said first heat source side heat exchanger or said second heat source side heat exchanger is controlled in response to the outdoor air temperature.

13. A refrigeration cycle device as claimed in claims 12, wherein when the outdoor temperature is decreased, the efficiency of heat exchange of said first heat source side heat exchanger and said second heat source side heat exchanger is decreased by only using one of said first heat source side heat exchanger or said second heat source side heat exchanger.

14. A refrigeration cycle device as claimed in claims 13, wherein when the outdoor temperature is increased, the efficiency of heat exchange of said first heat source side heat exchanger and said second heat source side heat exchanger is increased.

15. A refrigeration cycle device comprising a first compressor, a second compressor driven by recovered power recovered by an expansion machine, refrigerant flow path changeover means, a load side heat exchanger, a first heat source side heat exchanger and a second heat source side heat exchanger;

wherein said first compressor and said second compressor are connected in series in a refrigerant flow path; said second heat source side heat exchanger is disposed in a flow path between said first compressor and said second compressor during the cooling operation; said first heat source side heat exchanger and said second heat source side heat exchanger during the cooling operation are in an integral structure or in a divided structure so that fins are not common in the direction of column; and wherein heat transfer area ratio, which is a ratio of the heat transfer area of the second heat source side heat exchanger relative to the total heat transfer area of the heat transfer areas of said first and second heat source side heat exchangers, is set, according to the air speed distribution, with the air speed distributions of said first and second heat source side heat exchanger taken into consideration, within a range including a point at which the COP is at a maximal, wherein an inlet portion of the first heat source side heat exchanger and an inlet portion of the second heat source side heat exchanger are connected therebetween by a first pipe having only a first check valve during the heating operation and an outlet portion of the first heat source side heat exchanger and an outlet portion of the second heat source side heat exchanger are connected therebetween by a second pipe having only a second check valve during the heating operation, wherein the first and the second check valves and the refrigerant flow path changeover means are arranged so that the first heat source side heat exchanger and the second heat source side heat exchanger are connected in series during the cooling operation and the first heat source side heat exchanger and the second heat source side heat exchanger are connected in parallel during the heating operation, and during the cooling operation, the outlet of the first compressor is connected to the inlet of the second heat source side heat exchanger, the outlet of the second heat source side heat exchanger is connected to the inlet of the second compressor, and the outlet of the second compressor is connected to the inlet of the first heat source side heat exchanger, and wherein an efficiency of heat exchange of the first heat source side heat exchanger or the second heat source side heat exchanger is controlled in response to at least one of an outdoor air temperature, an air conditioner load and an indoor air temperature.

16. A refrigeration cycle device as claimed in claim 15, wherein a fan is disposed at a position higher than the heat exchanger, and said second heat source side heat exchanger is disposed at a position higher than said first heat source side heat exchanger, and said heat transfer area ratio is set at 0.13-0.45.

17. A refrigeration cycle device as claimed in claim 15, wherein a fan is disposed at a position higher than the heat exchanger, and said second heat source side heat exchanger is disposed at a position lower than said first heat source side heat exchanger, and said heat transfer area ratio is set at 0.32-0.60.

18. A refrigeration cycle device comprising a first compressor, a second compressor driven by recovered power recovered by an expansion machine, refrigerant flow path changeover means, a load side heat exchanger, a first heat source side heat exchanger and a second heat source side heat exchanger;

wherein said first compressor and said second compressor are connected in series in a refrigerant flow path; said second heat source side heat exchanger is disposed in a flow path between said first compressor and said second compressor during the cooling operation; said first heat source side heat exchanger and said second heat source side heat exchanger during the cooling operation are in an integral structure or in a divided structure so that fins are not common in the direction of column; and wherein a fan is disposed above or beside of the heat exchanger and said second heat source side heat exchanger is disposed downstream side of said first heat source side heat exchangers, wherein a heat transfer area ratio, which is a ratio of the heat transfer area of the second heat source side heat exchanger relative to the total heat transfer area of the heat transfer areas of said first and second heat source side heat exchangers, is set, according to the air speed distribution, with the air speed distributions of said first and second heat source side heat exchanger taken into consideration, within a range including a point at which the COP is at a maximal, wherein an inlet portion of the first heat source side heat exchanger and an inlet portion of the second heat source side heat exchanger are connected therebetween by a first pipe having only a first check valve during the heating operation and an outlet portion of the first heat source side heat exchanger and an outlet portion of the second heat source side heat exchanger are connected therebetween by a second pipe having only a second check valve during the heating operation, wherein the first and the second check valves and the refrigerant flow path changeover means are arranged so that the first heat source side heat exchanger and the second heat source side heat exchanger are connected in series during the cooling operation and the first heat source side heat exchanger and the second heat source side heat exchanger are connected in parallel during the heating operation, and during the cooling operation, the outlet of the first compressor is connected to the inlet of the second heat source side heat exchanger, the outlet of the second heat source side heat exchanger is connected to the inlet of the second compressor, and the outlet of the second compressor is connected to the inlet of the first heat source side heat exchanger, and wherein an efficiency of heat exchange of the first heat source side heat exchanger or the second heat source side heat exchanger is controlled in response to at least one of an outdoor air temperature, an air conditioner load and an indoor air temperature.

19. A refrigeration cycle device, wherein an outdoor unit self-containing a first compressor, a second compressor driven by recovered power recovered by an expansion machine, and a plurality of indoor units self-containing a load side heat exchanger and an on-off valve are connected by a pipe, and said plurality of indoor units are independently changeable between a cooling operation and a heating operation;

wherein said second compressor and said first compressor are connected in series in a refrigerant flow path; said second heat source side heat exchanger is disposed in a flow path between said first compressor and said second compressor during the cooling operation, and wherein the operation is performed by the utilization of said first heat source side heat exchanger and said second heat source side heat exchanger irrespective of the operation modes of said indoor units, wherein an on-off valve disposed at the inlet portion of said expansion machine and having an adjustable degree of opening as well as an on-off valve bypassing said expansion machine and having an adjustable degree of opening are provided, and wherein both said on-off valves are controlled to control the temperature or the pressure from the outlet of said second compressor to the inlet of said expansion machine, wherein an inlet portion of the first heat source side heat exchanger and an inlet portion of the second heat source side heat exchanger are connected therebetween by a first pipe having only a first check valve during the heating operation and an outlet portion of the first heat source side heat exchanger and an outlet portion of the second heat source side heat exchanger are connected therebetween by a second pipe having only a second check valve during the heating operation, wherein the first and the second check valves and the refrigerant flow path changeover means are arranged so that the first heat source side heat exchanger and the second heat source side heat exchanger are connected in series during the cooling operation and the first heat source side heat exchanger and the second heat source side heat exchanger are connected in parallel during the heating operation, and during the cooling operation, the outlet of the first compressor is connected to the inlet of the second heat source side heat exchanger, the outlet of the second heat source side heat exchanger is connected to the inlet of the second compressor, and the outlet of the second compressor is connected to the inlet of the first heat source side heat exchanger, and wherein an efficiency of heat exchange of the first heat source side heat exchanger or the second heat source side heat exchanger is controlled in response to at least one of an outdoor air temperature, an air conditioner load and an indoor air temperature.

20. A refrigeration cycle device as claimed in claims 19, wherein a refrigerant that is generally used in a super critical condition is used as a refrigerant.

* * * * *